US006285845B1

(12) United States Patent
Liatard et al.

(10) Patent No.: US 6,285,845 B1
(45) Date of Patent: Sep. 4, 2001

(54) CARD CLEANING DEVICE AND METHOD OF USE

(75) Inventors: Yves Liatard, Nantes; Gaetan Heno, Ancenis, both of (FR)

(73) Assignee: ZIH Corp., Wilmington, DE (US)

( * ) Notice: Subject to any disclaimer, the term of this patent is extended or adjusted under 35 U.S.C. 154(b) by 0 days.

(21) Appl. No.: 09/483,624

(22) Filed: Jan. 13, 2000

Related U.S. Application Data

(60) Provisional application No. 60/133,578, filed on May 11, 1999.

(51) Int. Cl.[7] ..... G03G 15/00; A46B 15/00

(52) U.S. Cl. ..... 399/107; 15/3; 15/256.51; 399/123

(58) Field of Search ..... 399/107, 123, 399/124, 361, 363, 381, 382, 383, 390, 411; 347/171; 400/701; 15/3, 102, 256.51, 256.52

(56) References Cited

U.S. PATENT DOCUMENTS 4,009,047 * 2/1977 Lindsay ..... 15/3 X
4,982,469 * 1/1991 Nishiwaki ..... 15/3
5,349,714 * 9/1994 Korbonski et al. ..... 15/3
5,989,358 * 11/1999 Korbonski ..... 15/102 X

FOREIGN PATENT DOCUMENTS

3740044 * 6/1989 (DE) .

* cited by examiner

*Primary Examiner*—Susan S. Y. Lee
*Assistant Examiner*—Hoan Tran
(74) *Attorney, Agent, or Firm*—Fulbright & Jaworski L.L.P.

(57) ABSTRACT

An improved cleaning system adapted to be incorporated into an image forming device, the improved cleaning system having a roller cartridge having an upper cleaning roller rotatably and removably coupled to a cartridge frame, a lower cleaning roller rotatably and vertically movably coupled to the cartridge frame for cleaning printable media, an elastic mechanism coupled to the cartridge frame for pressing the upper cleaning roller against the lower cleaning roller, a magnetic mechanism for holding the improved cleaning system firmly inside the image forming device, a latch mechanism for latching the improved cleaning system to the image forming device, a drive mechanism for driving the printable media between the drive mechanism and the lower cleaning roller, the improved cleaning system being adapted to clean dust deposited on the surface of the printable media.

37 Claims, 25 Drawing Sheets

CARD CLEANING DEVICE AND METHOD OF USE

RELATED APPLICATION

This application is an U.S. Application claiming the benefit of the U.S. Provisional Application No. 60/133,578, filed on May, 11, 1999, the contents of that application are incorporated herein by reference.

FIELD OF THE INVENTION

The present invention relates generally to an image forming device, and more particularly to an improved cleaning system adapted to be incorporated into a printer for cleaning printable media fed into the printer prior to being printed.

BACKGROUND OF THE INVENTION

A conventional image forming device, such as a printer, sometimes includes a cleaning mechanism for cleaning a printable medium, such as a PVC or plastic card, fed into the printer before the printable medium is printed by the printer. There are different types of commercially available printable media, e.g., regular papers, thermal papers, or plastic cards, and each conventional printer is specifically adapted to print images on at least one type of the printable media. However, some conventional image forming devices may be adapted to print images on one or more types of the printable media, e.g., cards and paper.

Each printable medium has at least one printable surface on one side and, oftentimes, on both sides of the printable media. Some printable media have greater tolerance to pollution, such as dust particles, on the printable surfaces of the printable media and are still receptive to the printer for printing images thereon even though the printable surfaces of the printable media might not be very clean. For instance, a conventional printer adapted to print images on regular papers typically uses a ribbon for transferring images to the surfaces of the papers, or it may use an injection mechanism to project carbon particles on the surfaces of the papers to form images. The carbon particles ordinarily are well defined during printing and would not disperse once deposited on the surface of the paper. Thus, a light deposition of dust particles on the printable surface of the regular paper normally does not greatly degrade a printing result on the paper, such as by blurring. However, for some other types of printable media, such as the PVC cards or the plastic cards, it is particularly important that the printable surfaces of these printable media be extremely clean before printing in order to have good quality print results. Normally, these printable media, e.g., the plastic cards, require a high temperature thermal printing process to form images. Ordinarily, the temperature of the thermal printing process used to form images on these plastic printable media is very high, often much higher than a temperature of the thermal printing process, if any, needed to print on regular paper. As a result, if the printable surfaces of these printable media, e.g., the plastic cards, are not clean, the images printed thereon tend to be blurred due to this high temperature process. Even a slight deposition of dust particles on the printable surface of the plastic card will likely blur the images to be formed and greatly affect the quality of the printing results. Thus, having a cleaning mechanism is necessary for the printer adapted to print plastic or PVC cards.

The cleaning mechanism in a conventional printer typically is located inside the printer and is adjacent to a feeding mechanism. The feeding mechanism of the printer is accessible from outside for loading or unloading a printable medium stack onto the feeding mechanism. During operation, the feeding mechanism feeds the printable media, such as cards, into the printer to be printed by a print head of the printer. The cleaning mechanism of the conventional printer is coupled to the conventional printer between the feeding mechanism and the print head. Therefore, the cleaning mechanism may clean the printable medium, such as a card, fed into the printer before the card is printed by the print head.

The conventional cleaning mechanism typically includes a cleaning roller and a drive roller rotatably coupled to a support frame securely mounted to the conventional printer. The cleaning roller and the drive roller are approximately positioned in parallel to each other. The drive roller normally is rotatably coupled to the support frame and cannot be moved either laterally or vertically. The cleaning roller, however, is often rotatably coupled to the support frame by coupling both ends of a cleaning roller shaft of the cleaning roller to the support frame. The cleaning roller is properly located so that it can be positioned directly above the drive roller and is adapted to press the printable medium against the drive roller. Moreover, positions of the drive roller and the cleaning roller inside the printer are precisely disposed to allow the printable media traveling there between. A drive roller shaft of the drive roller is coupled to a gear system of the conventional printer for rotation, and the gear system is further coupled to a motor of the printer, where the motor is adapted to control the rotation of the drive roller.

When the printable medium, such as a card, is fed into the printer by the feeding medium, the card will urge the movable cleaning roller slightly up by approximately the thickness of the card. Due to the compression effect, the cleaning roller will press the card against the drive roller located underneath. The cleaning roller is typically made by silicone materials molded to the roller shape for encircling the cleaning roller shaft. In addition, a treatment process is applied to the cleaning roller for making the silicone surface of the cleaning roller sticky. The above-mentioned treatment process is well known to persons skilled in the art and is not an aspect of the present invention. Most commercially available printers incorporating the cleaning systems have the drive rollers made of the same materials as are commonly used for making the platens of the printers. When the drive roller is rotated by the motor, it drives the card toward the print head. As mentioned, the cleaning roller presses the card against the drive roller, so when the card is driven through by the drive roller, the card will cause the cleaning roller to rotate due to the sticky effect of the silicone surface of the cleaning roller.

Moreover, the sticky surface of the cleaning roller serves the purpose of removing undesirable pollutants, such as dust particles, deposited on the printable surface of the card. When the card moves through between the cleaning roller and the drive roller, the cleaning roller would pick up dust particles deposited on the surface of the card facing the cleaning roller due to the sticky effect of the cleaning roller. Thus, the printable surface of the card should face the cleaning roller for cleaning. Alternatively, drive rollers of some conventional printers are made of sticky silicone materials similar to the cleaning roller. As a result, the drive roller and the cleaning roller of these printers are adapted to clean opposite surfaces of the card. The printable surface of the card may therefore face either up or down for cleaning, or both sides of the card could be printable surfaces.

The sticky surface of the cleaning roller removes dust particles from the card surface by sticking the dust particles out of the printable surface of the card as the card rolls through the cleaning roller. After being removed from the card, the dust particles will stick to the surface of the cleaning roller. As a result, the surface of the cleaning roller accumulates more dust particles each time the cleaning roller cleans a card, and the efficacy of the cleaning roller is accordingly reduced after each cleaning. At some point in time, the cleaning roller will no longer be able to effectively remove any more dust particles from the cards due to the dirtiness on its surface. The cleaning roller, therefore, needs to be clean, or even be replaced, periodically to maintain the effectiveness of the cleaning system of the conventional printer.

As stated, the cleaning roller is coupled to the printer by inserting its cleaning roller shaft into a pair of slots on the support frame of the printer. Generally, the slots are located deep inside the printer, so it is quite difficult and inconvenient to install, to replace, or to remove the cleaning roller for cleaning or for maintenance purposes. Since the drive roller is positioned underneath the cleaning roller in the printer, it is even harder to remove or to replace those drive rollers that also serve the function to clean the cards and therefore need to be cleaned periodically. Moreover, the size of the cleaning roller in a typical conventional printer is quite small. Usually, the cleaning roller has a width of approximately 2.4 inches—slightly wider than the width of a regular business card, and it has a diameter of approximately 0.6 inches. Thus, the cylindrical surface of the cleaning roller gets saturated by the dust particles quite easily because the surface of the cleaning roller is quite small, and the cleaning roller needs to be cleaned frequently. As a result, an improved cleaning system is needed to redress the difficult accessibility problem and the necessity of frequent cleaning issue.

SUMMARY OF THE INVENTION

In a preferred embodiment, the cleaning system according to the present invention comprises a roller cartridge having a lower cleaning roller and an upper cleaning roller. The lower cleaning roller is rotatably and movably coupled to a cartridge frame of the roller cartridge at a lower end, and the upper cleaning roller is adapted to be removably and rotatably coupled to the cartridge frame for pressing against the lower cleaning roller. The roller cartridge has a receptive means adapted to removably receive the upper cleaning roller. The roller cartridge includes a latching means adapted to couple the roller cartridge to an image forming device, such as a printer, and the roller cartridge further comprises a fixing means adapted to hold it steady within the printer. The roller cartridge is easily removable from the printer, and the upper cleaning roller is easily removable from the roller cartridge. The upper cleaning roller is made of low cost consumable materials to be cost effective. The cleaning system of the present system is also adapted to clean printable media having widely different thicknesses.

The foregoing and additional features and advantages of this present invention will become apparent by way of non-limitative examples shown in the accompanying drawings and detailed description that follow. In the figures and written description, numerals indicate the various features of the invention, like numerals referring to like features throughout for both the drawing figures and the written description.

DETAILED DESCRIPTION OF THE PREFERRED EMBODIMENT

Figure 1:
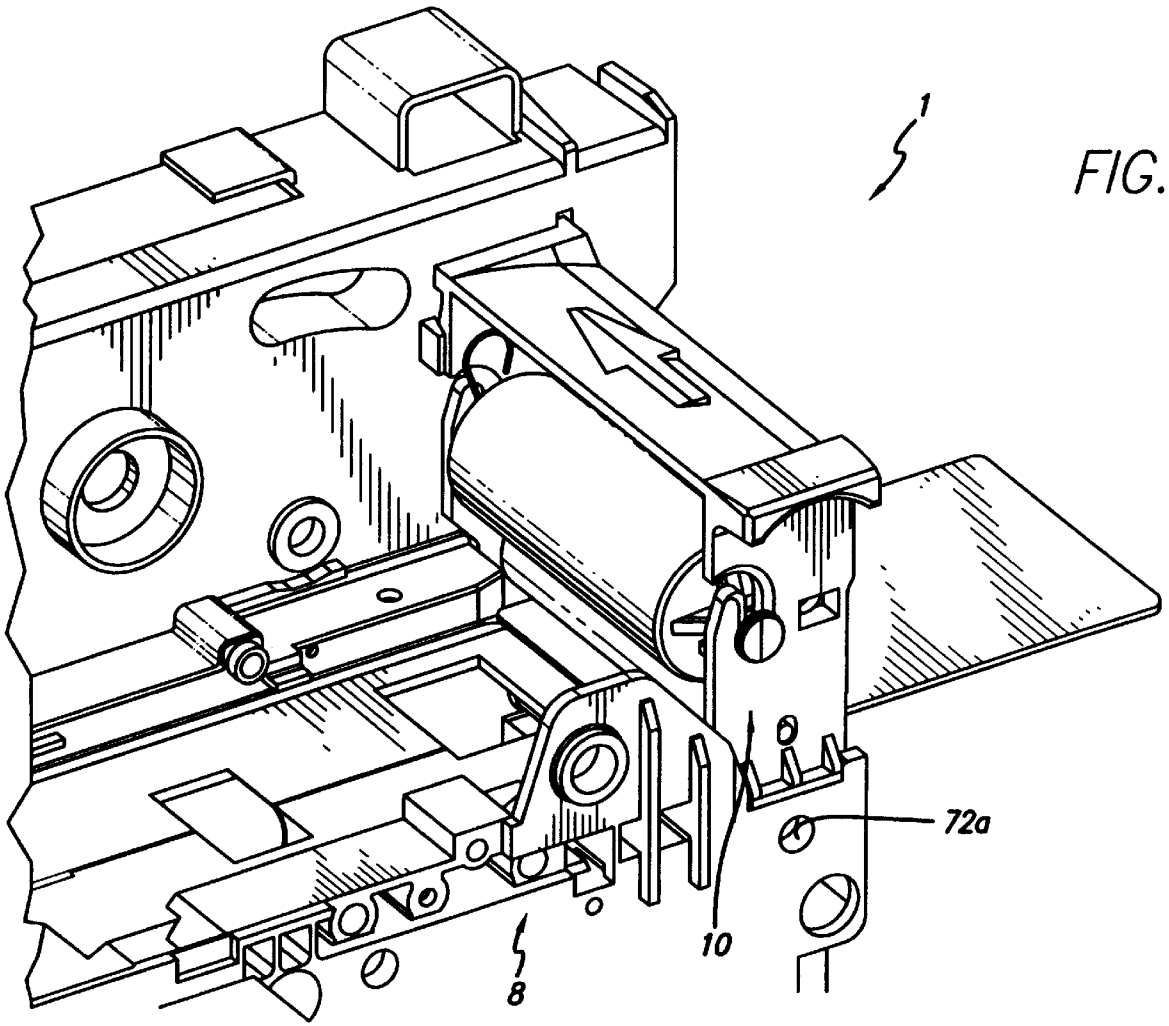
FIG. 1 shows a partial perspective view of a printer having a cleaning system assembly coupled into the printer according to the present invention.

In FIG. 1, a roller cartridge 10 of the cleaning system according to the present invention is incorporated into a printer 1 between a feeding mechanism (not shown) and a print head (not shown) of the printer 1. The feeding mechanism has a receptacle means (not shown) adapted to store a stack of printable media, such as plastic cards, to be fed into the printer 1 by the feeding mechanism. The feeding mechanism sequentially moves the cards into the body 8 of the printer 1 to avoid jamming the printer 1 during printing.

Inside the body 8 of the printer 1, a drive roller 30 (FIG. 7) is positioned adjacent to the feeding mechanism for receiving the cards fed into the body 8 by the feeding mechanism. The drive roller 30 has a drive roller shaft (not shown) rotatably coupled to a pair of receptive holes such as hole 72*a* (FIGS. 1, 5, 6) disposed at each end of a support frame (not shown) of printer. In the preferred embodiment, the special position of the drive roller 30 within the printer 1 is predetermined and generally cannot be changed. Thus, the drive roller 30 basically cannot move horizontally or vertically with respect to the body 8 of the printer 1, although it is rotatable to drive the cards toward the print head.

A gear system (not shown) positioned inside the body 8 of the printer 1 is coupled to the drive roller shaft at one end for rotating the drive roller 30. The gear system is further coupled to a motor (not shown), also positioned inside the printer body 8 of the printer 1. The motor is adapted to rotate the drive roller 30 through the connection of the gear system.

Figure 2:
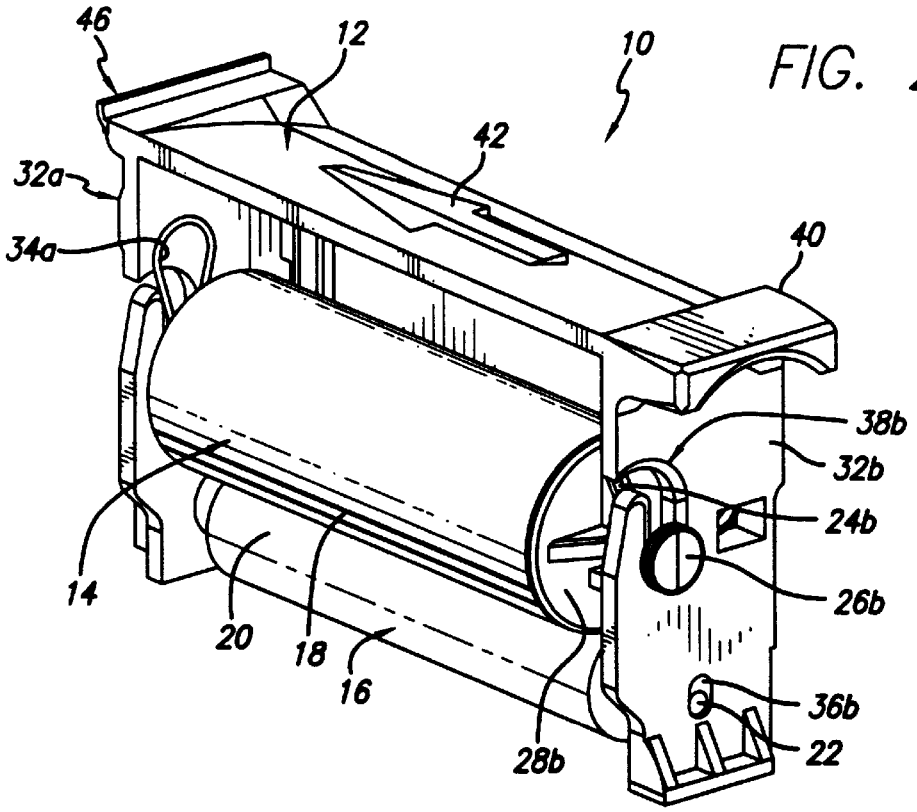
FIG. 2 shows a perspective view of the cleaning system assembly of FIG. 1.

Referring to FIG. 1, the roller cartridge 10 is positioned inside the printer 1 adjacent to the feeding mechanism and is directly over the drive roller 30. The roller cartridge 10 has a lower cleaning roller 16 movably coupled to a cartridge frame 12 at opposite ends, as shown in FIG. 2. The lower cleaning roller 16 comprises a lower roller body 20 and a lower roller shaft 22 wherein the lower roller body 20 securely encircles the lower roller shaft 22. A pair of generally elliptically shaped slots 36*a*, 36*b* are respectively positioned on left and right side walls 32*a*, 32*b* of the cartridge frame 12 near a bottom end. Opposite ends of the lower roller shaft 22 are respectively inserted into the elliptically shaped slots 36*a*, 36*b*, which are adapted to allow the ends of the lower roller shaft 22 to slide vertically along the long axes of the elliptically shaped slots 36*a*, 36*b*. The short axes of the elliptically shaped slots 36*a*, 36*b* are slightly larger than diameters of the ends of the lower roller shaft 22—just enough to accommodate the ends therein, so that the lower roller shaft 22 may not move horizontally within the elliptically shaped slots 36*a*, 36*b*, as shown in FIG. 2. As a result, the lower cleaning roller 16 may only move vertically with respect to the cartridge frame 12.

In the preferred embodiment, the drive roller 30 is made of ordinary platen materials. Thus, the surface of the drive roller 30 is usually not sticky, and driving a card situated over the drive roller 30 requires a pressure from above the card surface pressing the card against the drive roller 30. The pressure comes from the lower cleaning roller 16 of the roller cartridge 10. When the roller cartridge 10 is mounted on inside the printer 1, the lower cleaning roller 16 is positioned generally parallel to and directly above the drive roller 30. The lower cleaning roller 16 is located near the bottom of the roller cartridge 10, so that when the roller cartridge 10 is properly mounted on the printer 1, the lower cleaning roller 16 would, due to its weight and the pressure from a upper cleaning roller 14, press against the drive roller 30. As a result, the cards will be driven between the drive roller 30 and the lower cleaning roller 16 as the cards are sequentially fed by the feeding mechanism.

As stated, the lower cleaning roller 16 is vertically movable within the roller cartridge 10 while, in the preferred embodiment, the drive roller 30 is immovably, albeit rotatably, coupled to the printer 1 but cannot readjust its vertical position within the printer 1. When a card is fed between the lower cleaning roller 16 and the drive roller 30, the card will upwardly displace the lower cleaning roller 16 by the thickness of the card, while the frame 12 of the roller cartridge 10 is coupled to the printer 1 by a pair of magnets 68*a*, 68*b* (FIG. 4) and does not move upward. In addition, the length of the long axes of the elliptically shaped slots 36*a*, 36*b* is selected to accommodate the thickest cards possibly intended to be fed into the printer 1 for printing. Thus, the upper most position that the lower cleaning roller 16 might reach is determined by the length of each of the long axes of the elliptically shaped slots (e.g., slots 36*b* in FIG. 2).

As a card is fed between the lower cleaning roller 16 and drive roller 30, the card is driven by the drive roller 30, which comes into contact with a bottom surface of the card, toward the print head. The lower cleaning roller 16 is adapted to remove dust from the surface of the card coming into contact with the lower cleaning roller 16. Unlike the drive roller 30, no gearing system is coupled to the lower cleaning roller 16 to drive it. Moreover, the roller body 20 of the lower cleaning roller 16 is commonly made of 35 Shore-A silicone materials, the surface of which, after processed, will be slightly sticky. A manufacturing procedure to mold the silicone materials into a sticky roller is well known in the art and is not a concern of the present invention. Due to the sticky surface of the lower roller body 20, when the card is driven toward the print head by the drive roller 30 between the lower cleaning roller 16 and the drive roller 30, the card will cause the lower cleaning roller 16 to rotate over the full length of the printable surface, which faces the lower cleaning roller 16 in the preferred embodiment. As a result, the sticky surface of the lower roller body 20 will pick up dust particles deposited on the printable surface of the card while the card is moved over it. The sticking power of this lower cleaning roller 16, however, shall not be too high. Otherwise, the lower roller body 20 will not only pick up the dust particles off the card surface but will also stick to the card itself causing the card to jam the printer 1. The 35 Shore-A silicone materials commonly used to make the lower roller body 20 provide an ideal sticky surface, i.e., sticky enough to pick up most dust particles on the printable surface but not too sticky so as not to jam the printer 1.

The lower roller body 20 has a low hardness in order not to damage the printable surfaces of the cards. As mentioned, the lower roller body 20 will attach some dust to its surface during cleaning. Thus, if the surface of the lower roller body 20 is too hard, it will probably cause damages, such as scratches, to the printable surface of the card when it rolls over the card. Moreover, the low hardness of the lower roller body 20 allows a small distortion of its surface when under pressure. Hence, it provides a good contact between the lower cleaning roller 16 and the card because a contact surface between them increases when the hardness of the lower roller body 20 decreases and the contact surface is always on the whole card width, even if there are dust particles on the card, due to the slight distortion of the surface of the lower roller body 20. Again, a lower roller body 20 made by the commonly used silicone materials provides an ideal hardness to the surface in the preferred embodiment. In other alternative embodiments, other materials may also be adopted to make the lower roller body 20 as long as the stickiness and the hardness qualities of the final product will fit the abovementioned principles according to the present invention.

Each time the lower cleaning roller 16 rolls over a card to clean its printable surface, the surface of the lower roller body 20 gets dirtier accordingly. Consequently, as soon as this lower cleaning roller 16 gets some dust on its surface, its cleaning power decreases. A method to keep the surface of the lower roller body 20 clean is therefore needed. As stated previously, the cleaning roller in a conventional printer needs to be removed frequently in order to clean the surface of the cleaning roller or to replace a new one. Removing and cleaning a cleaning roller from the conventional printer is not convenient and may be quite labor intensive. Furthermore, the cleaning roller gets dirty frequently, and replacing a new one each time it gets dirty is not very cost effective. All these problems are resolved by the present invention, as will be explained in further detail.

Figure 3:
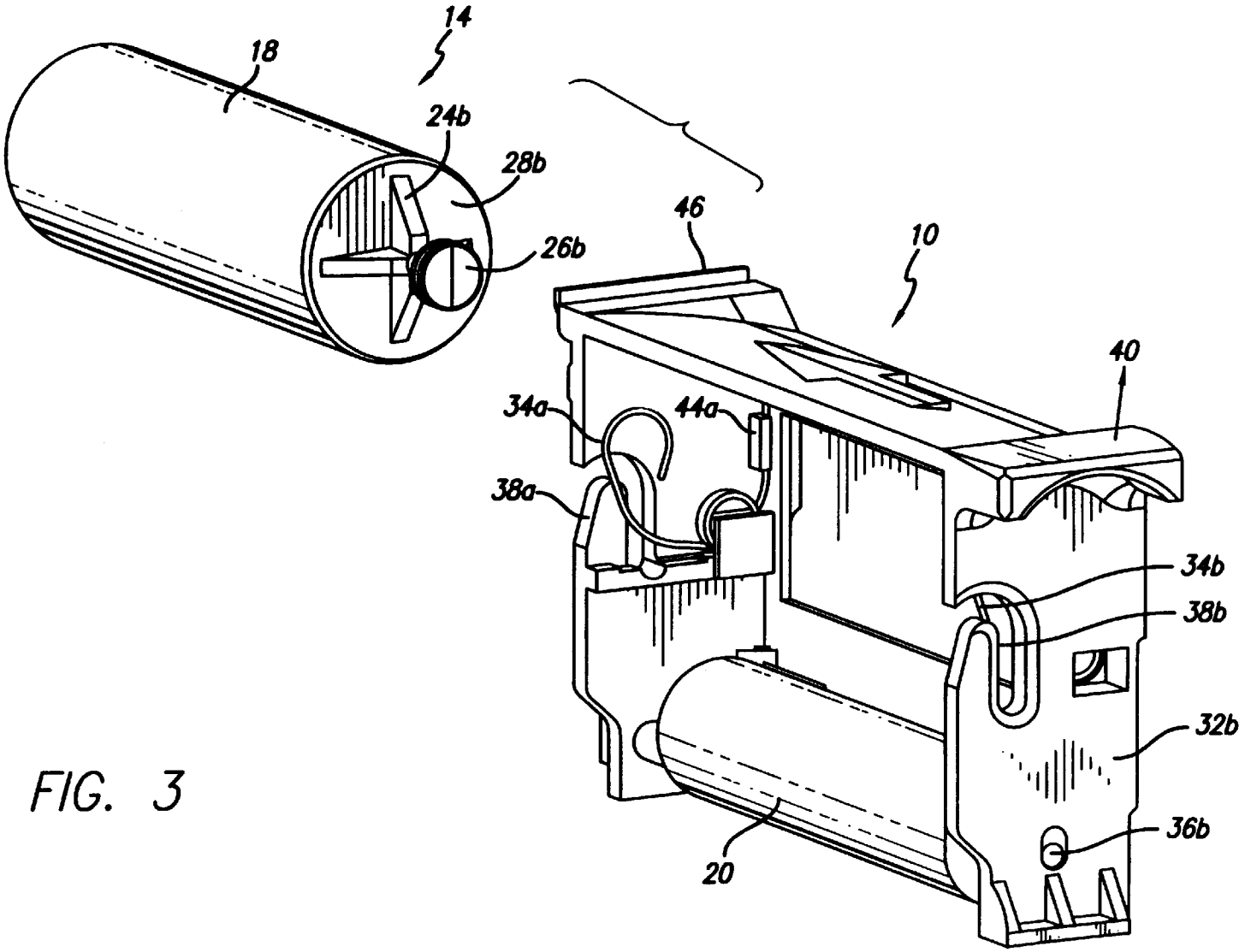
FIG. 3 shows a perspective view of the cleaning system assembly of FIG. 2 having the upper cleaning roller removed.

In the preferred embodiment according to the present invention, an additional upper cleaning roller 14 is included in the roller cartridge 10. Referring to FIG. 3, the upper cleaning roller 14 comprises an upper roller body 18 capped by an end cap at each end, 28*a* or 28*b*. The end caps 28*a*, 28*b* each includes cap nobs 26*a*, 26*b* respectively coupled to a support rack 24*a* or 24*b* through narrow nob necks. The upper cleaning roller 14 is rotatably coupled to the side walls 32*a*, 32*b*, and is positioned directly above the lower cleaning roller 16. A pair of open slots 38*a*, 38*b* having approximately reverse-J shape are respectively formed in the side walls 32*a*, 32*b*. The narrow nob necks of the cap nobs 26*a*, 26*b* are adapted to slide into and be received by the open slots 38*a*, 38*b*. The cap nobs 26*a*, 26*b* are much larger than their respective nob necks. As a result, the upper cleaning roller 14 will not unintendedly fall off the roller cartridge 10 once it is mounted thereon, as shown in FIG. 2. The vertical length of the open slots 38*a*, 38*b* are also selected so that when the upper cleaning roller 14 is inserted into the open slots 38*a*, 38*b* of the roller cartridge 10, the upper roller body 18 is adapted to touch and press against the lower roller body 20. In addition, the diameters of the nob necks of the cap nobs 26*a*, 26*b* are smaller than the channel widths of the open slots 38*a*, 38*b*. Therefore, the nob necks may freely rotate and slide vertically within the open slots 38*a*, 38*b*, and the upper cleaning roller 14 will accordingly rotate and slide vertically.

Left and right leaf springs 34*a*, 34*b* are mounted to the inner side of the side walls 32*a*, 32*b*, as shown in FIGS. 2 and 3. The leaf springs 34*a*, 34*b* have extensions adapted to press down on the nob necks to in tern press the upper cleaning roller 14 downward against the lower cleaning roller 16. Thus, the upper cleaning roller 14 is adapted to be rotated by friction with the lower cleaning roller 16 when the lafter rotates. In the preferred embodiment, the left and right leaf springs have approximately 0.1 kg pressing force on the upper cleaning roller 14.

The upper roller body 18 comprises a tube shape roller and a sticky strip is wrapped over the tube shape roller. The sticky strip has a higher sticking power than the surface of the lower cleaning roller 16 and is thus adapted to remove dust deposited on the surface of the lower cleaning roller 16. As a result, the upper cleaning roller 14 removes directly from the lower cleaning roller 16 and indirectly from the cards. The sticky power of the surface of the upper roller body 18 is stronger than the sticky power of the surface of the lower roller body 20. Due to the high sticking power of the upper cleaning roller 14, the cleaning of the lower cleaning roller 16, and consequently the cleaning of the cards, is far more efficient than when using a duster or a cleaning card. Also, sticking power of the upper roller body 18 can be stronger than that of the lower roller body 20 since the upper roller body 18 does not touch the cards directly. Thus, the higher sticking power of the upper roller body 18 will not hold onto the cards and jam the printer 1. Thus, the lower cleaning roller 16 serves as an intermediate to transfer dust from the cards to the upper cleaning roller 14. Accordingly, the lower cleaning roller 16 does not need cleaning maintenance and its life is potentially much longer than those counterparts used in the conventional printers.

The upper cleaning roller 14 is also larger than the lower cleaning roller diametrically, so the upper cleaning roller 14 has a larger effective cleaning surface than the surface of the lower cleaning roller 16. In one embodiment where the upper cleaning roller 14 and the lower cleaning roller 16 have a same width—W, and the upper cleaning roller 14 has a radius R1 and the lower cleaning roller 16 has a radius R2, the effective cleaning surface of the upper cleaning roller 14 will be $2\pi WR1$ and the lower cleaning roller 16 will be $2\pi WR2$. The effective cleaning surface difference between the upper cleaning roller 14 and the lower cleaning roller 16 will be $2\pi W(R1-R2)$. In this embodiment, W is approximately 2.4 inches, R1 is approximately 0.5 inches, and R2 is approximately 0.3 inches. Thus, the effective cleaning surface of the upper cleaning roller 14 is much larger than the effective cleaning surface of the lower cleaning roller 16. As a result, the upper cleaning roller 14 can retain much more dust than the lower cleaning roller 16 and need not be cleaned as frequently as the smaller surface of the cleaning roller used in the conventional printer.

The upper cleaning roller 14 is also vertically movable when mounted on the roller cartridge 10. When the card upwardly displaces the lower cleaning roller 16, as stated above, the upper cleaning roller 14 is also upwardly displaced accordingly. Thus, the upper cleaning roller 14 cleans the lower cleaning roller 16 when the latter cleans the printable surface of the card. In addition, the sticky strip of the upper roller body 18 is made of double-coated paper tape. Thus, the sticky strip and/or the whole upper roller body 18 are easily replaceable. In the preferred embodiment, the paper tape is approximately 12 mil thick having an adhesion force of 40 oz/inch and a tensile strength of 34 lb/inch. The upper roller body 18 is made of materials much cheaper than the silicone materials used to make the lower roller body 20. As compared to the conventional printers that replace the silicone cleaning rollers for maintenance, the present invention replaces the upper roller body 18 of the upper cleaning roller 14 or the sticky strip. By making the upper roller body 18 and/or the sticky strip replaceable, which is much cheaper than replacing the lower cleaning roller 16, the present invention is much more cost effective than the conventional printers.

Figure 4:
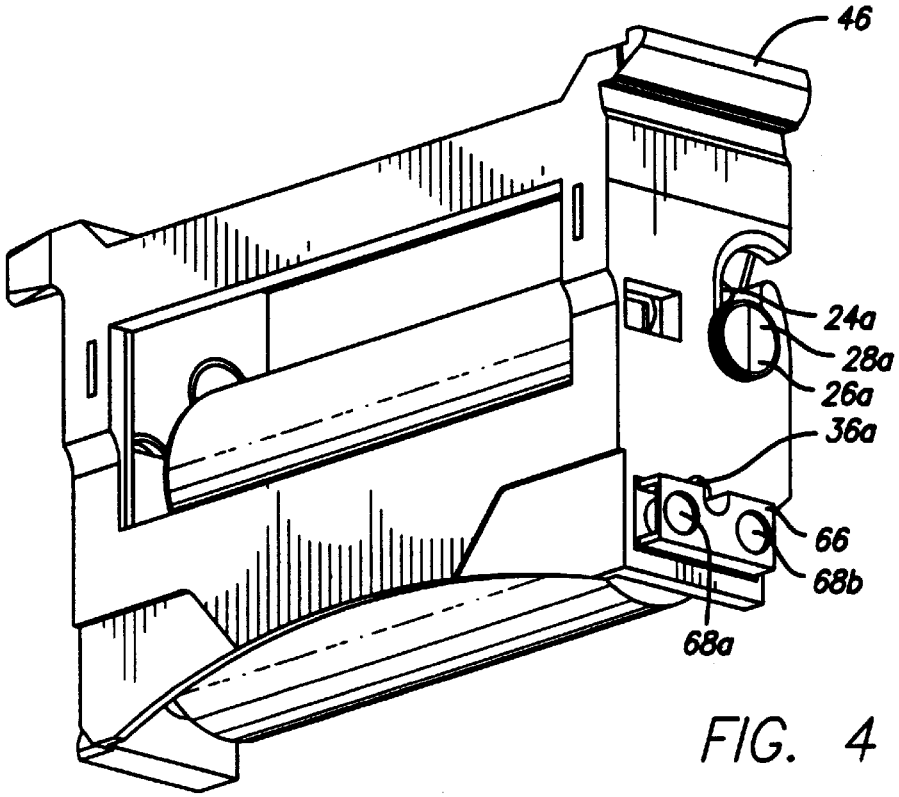
FIG. 4 shows a perspective view of the cleaning system assembly of FIG. 2, but from a lower perspective and from the reverse side.
Figure 5:
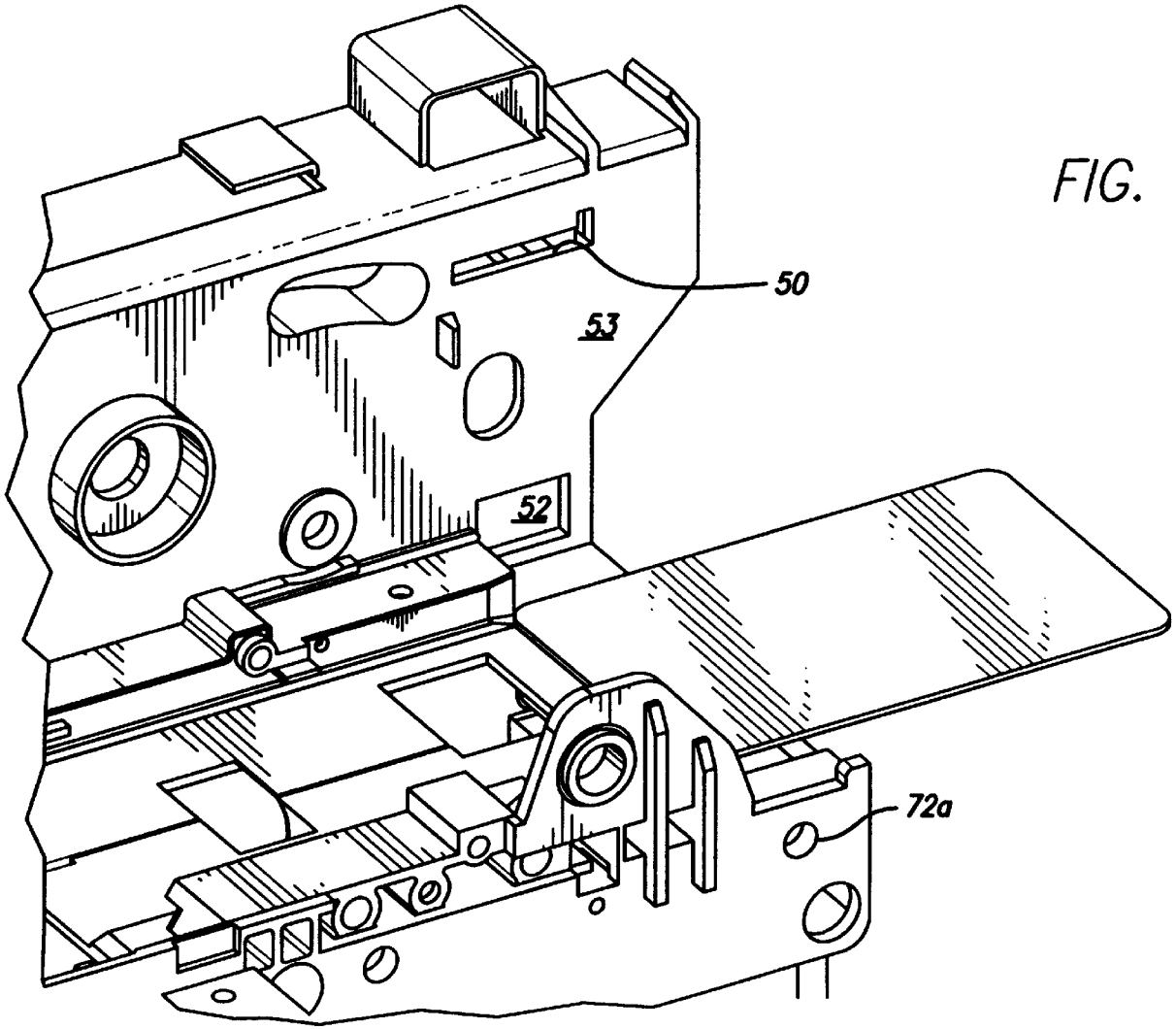
FIG. 5 shows a partial perspective view of the printer having the cleaning system assembly removed from the printer.

Unlike the conventional printers, the present invention also has the advantage of easy access to and easy replacement of the cleaning system. As can be seen from FIGS. 2 and 4, the roller cartridge 10 has a latch 46 at one end and a handle 40 at the opposite end, both on the top of the roller cartridge 10. The latch 46 is adapted to be inserted into a latch slot 50 located on a back wall 53 inside the printer 1, as shown in FIG. 5. The latch slot 50 is of the size slightly wider than the latch 46, so the latch 46 can be inserted therein but the latch slot 50 leaves not much extra space for the latch 46 to slide laterally or vertically. When the latch 46 is inserted into the latch slot 50, the latch 46 latches the roller cartridge 10 to the printer 1 by catching against the reverse side of the back wall 53. Furthermore, the roller cartridge 10 has the pair of magnets 68*a*, 68*b* positioned on the left side wall 32*a* at the outer side near the bottom (FIG. 4). The magnets 68*a*, 68*b* are held by a holder 66 securely mounted on the left side wall 32*a* at the outer side. When the roller cartridge 10 is mounted on the printer 1, the magnets 68*a*, 68*b* will be firmly held by strong magnetic forces to a metal plate 52, which is positioned inside the printer 1 under the slot 50. Thus, the roller cartridge 10 is securely mounted inside the printer 1 without undesired lateral movement during operation, as shown in FIG. 1. In the preferred embodiment, the magnetic force of each magnet is approximately 0.3 Kg at 0.5 mm, and the magnets are made of compressed Plasto-Neodymium materials. In alternative embodiments, other magnets made of different materials and/or providing different magnetic forces may be adopted without deviating from the noted inventive principle.

Figure 6:
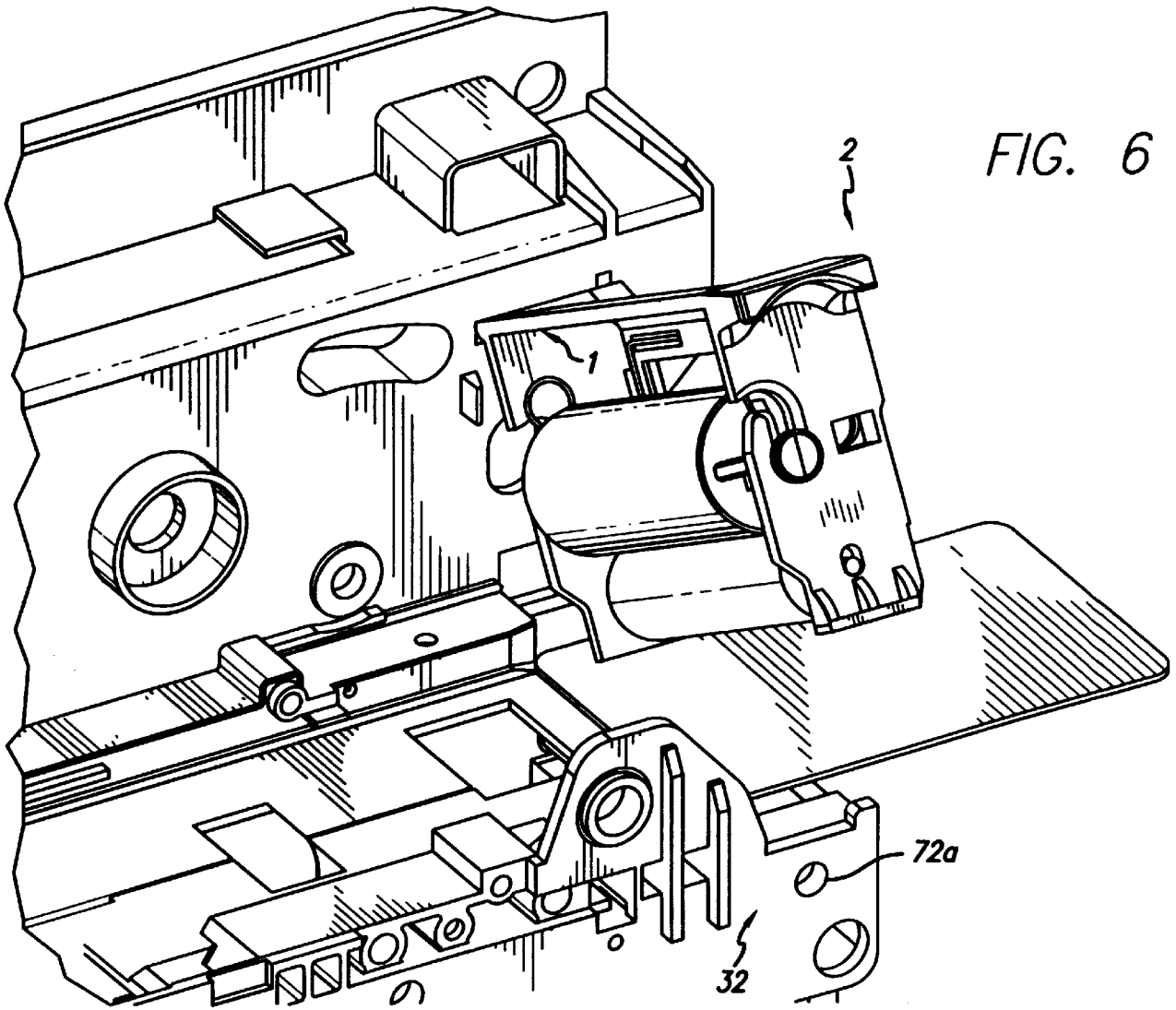
FIG. 6 shows a partial perspective view of the printer having the cleaning system assembly lifted for installation onto or for removal from the printer.
Figure 7:
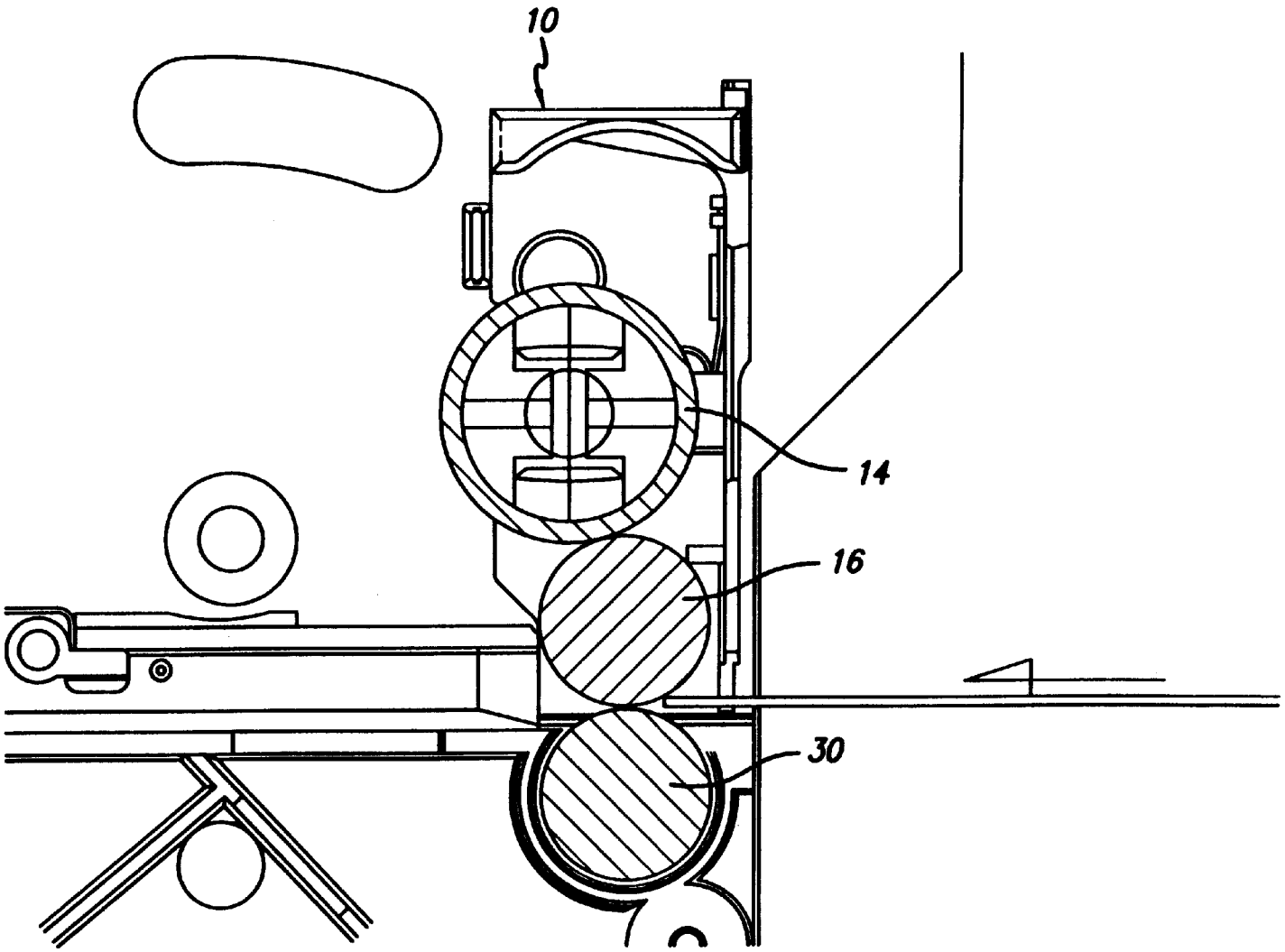
FIG. 7 shows a cross-sectional view of the printer and the cleaning system assembly in an operational position.
Figure 8:
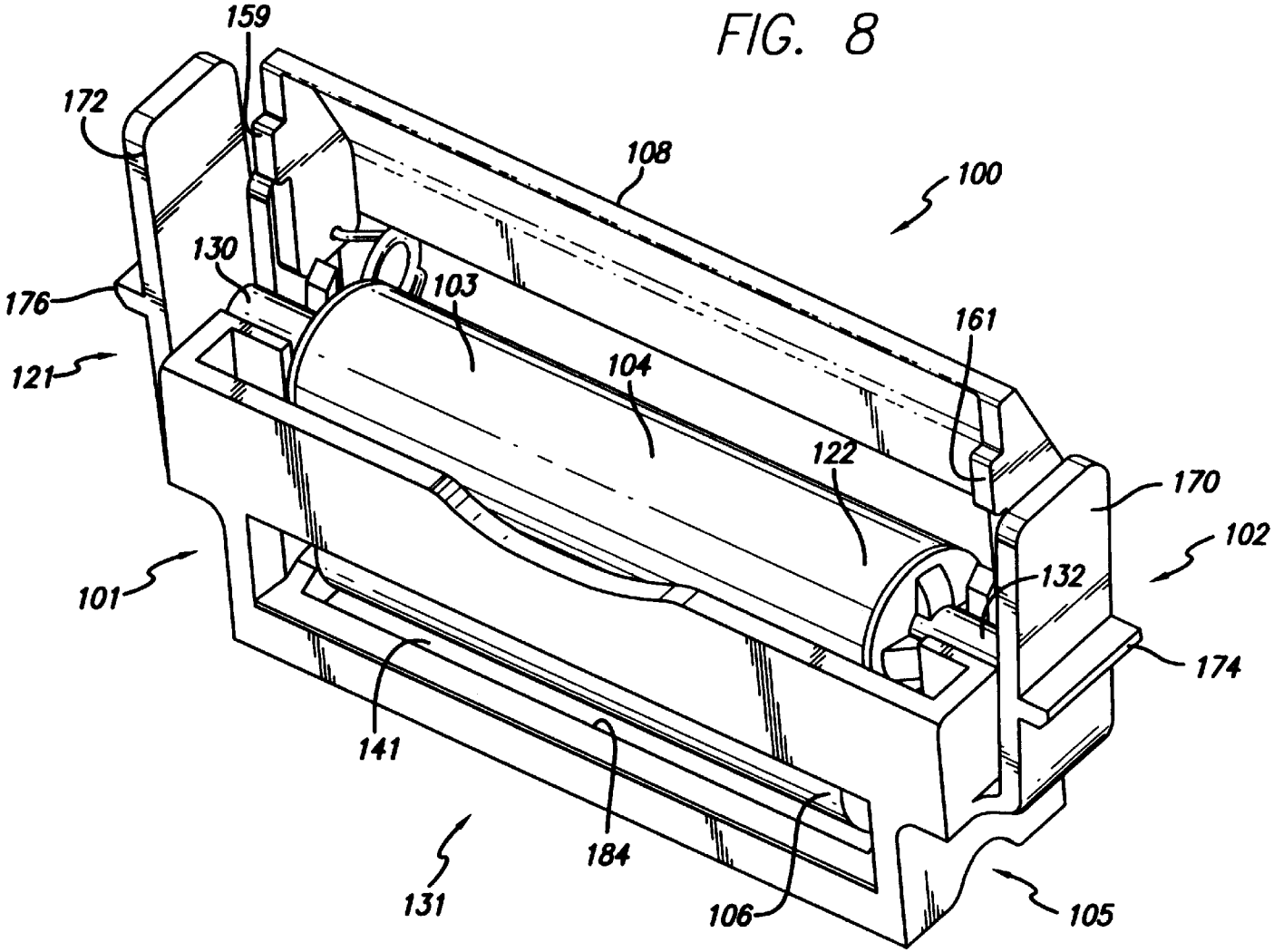
FIG. 8 is a perspective view of a cleaning system assembly.
Figure 9:
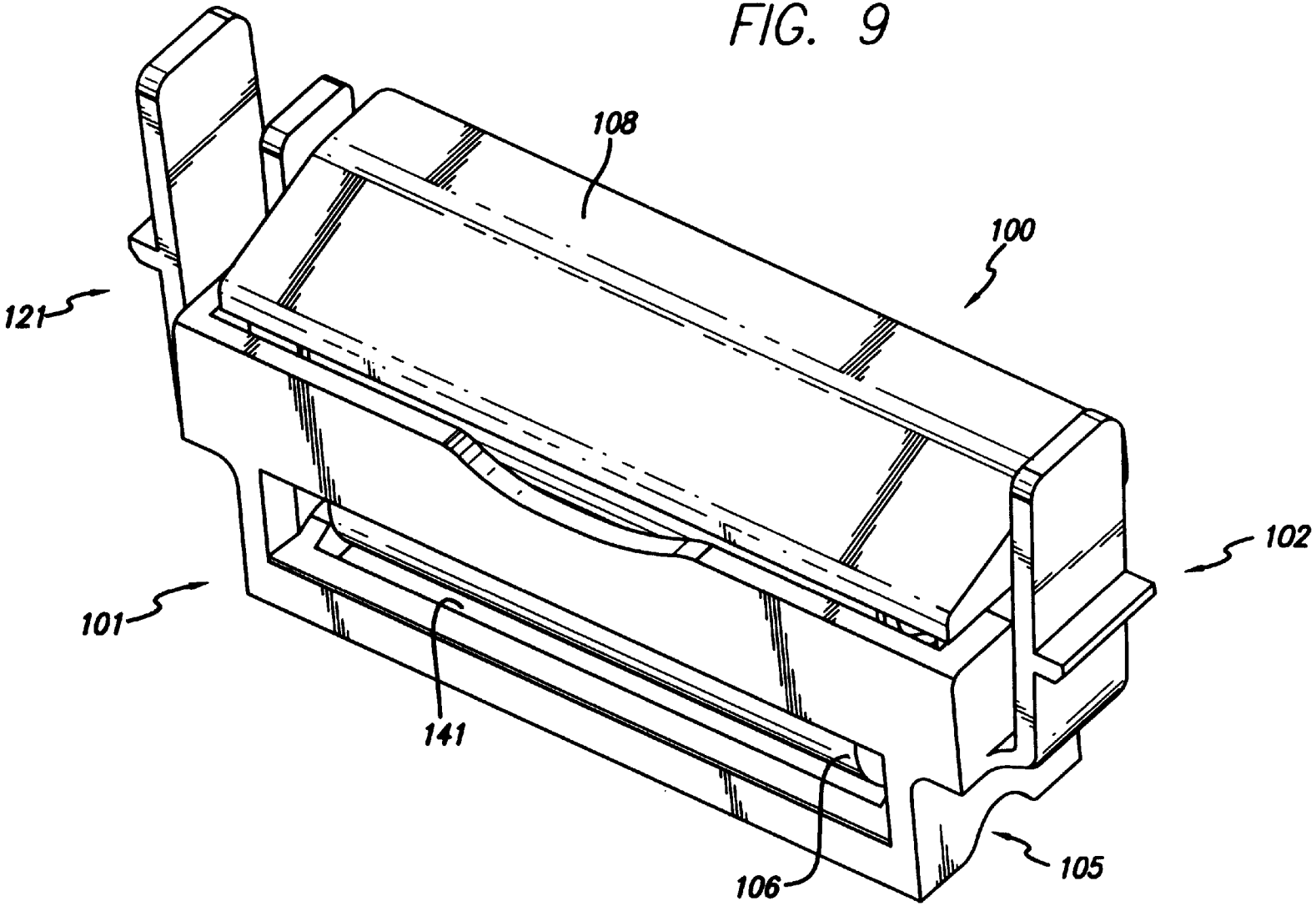
FIG. 9 is further perspective view of a cleaning system assembly.
Figure 10:
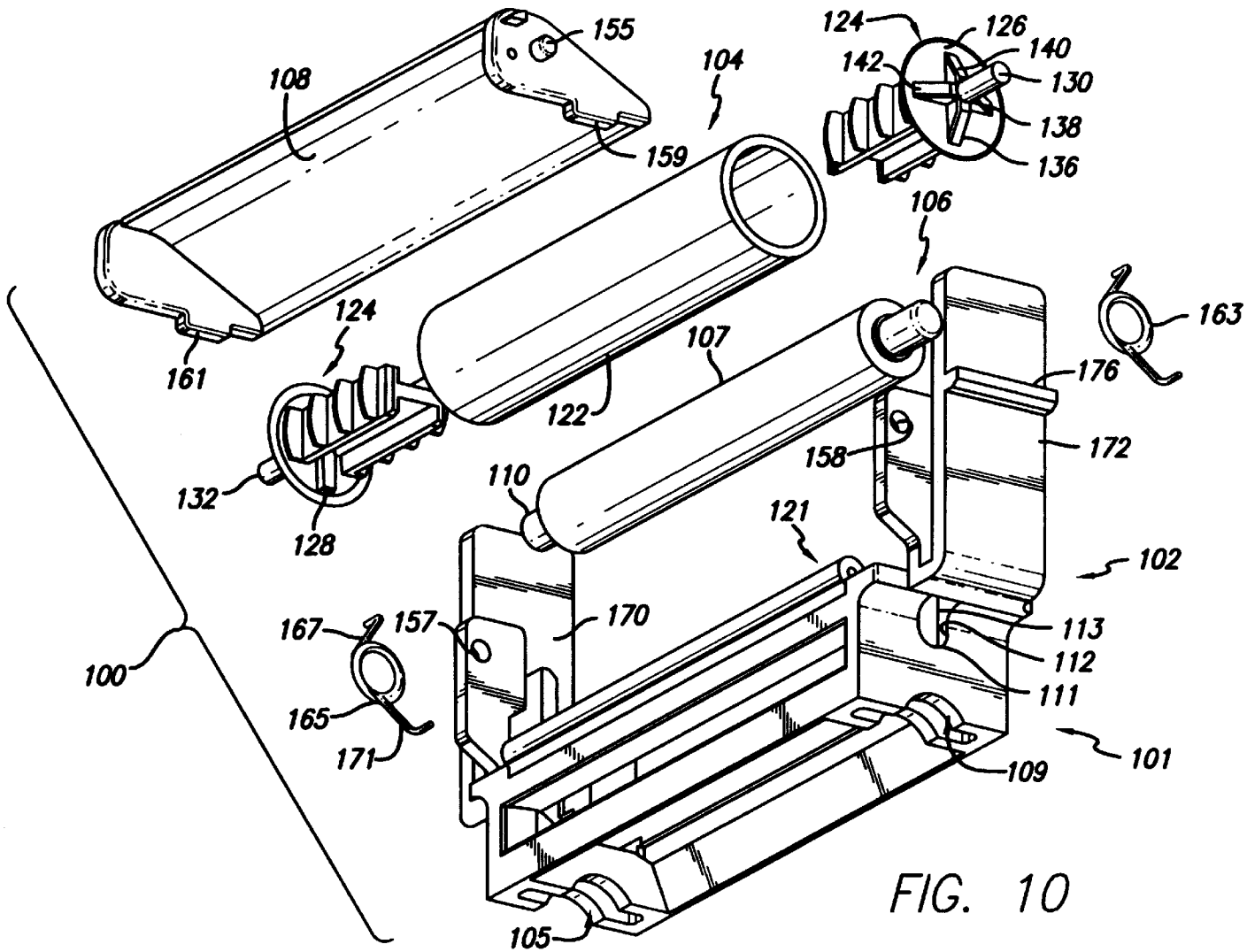
FIG. 10 is an explosed view of the cleaning system assembly.
Figure 11:
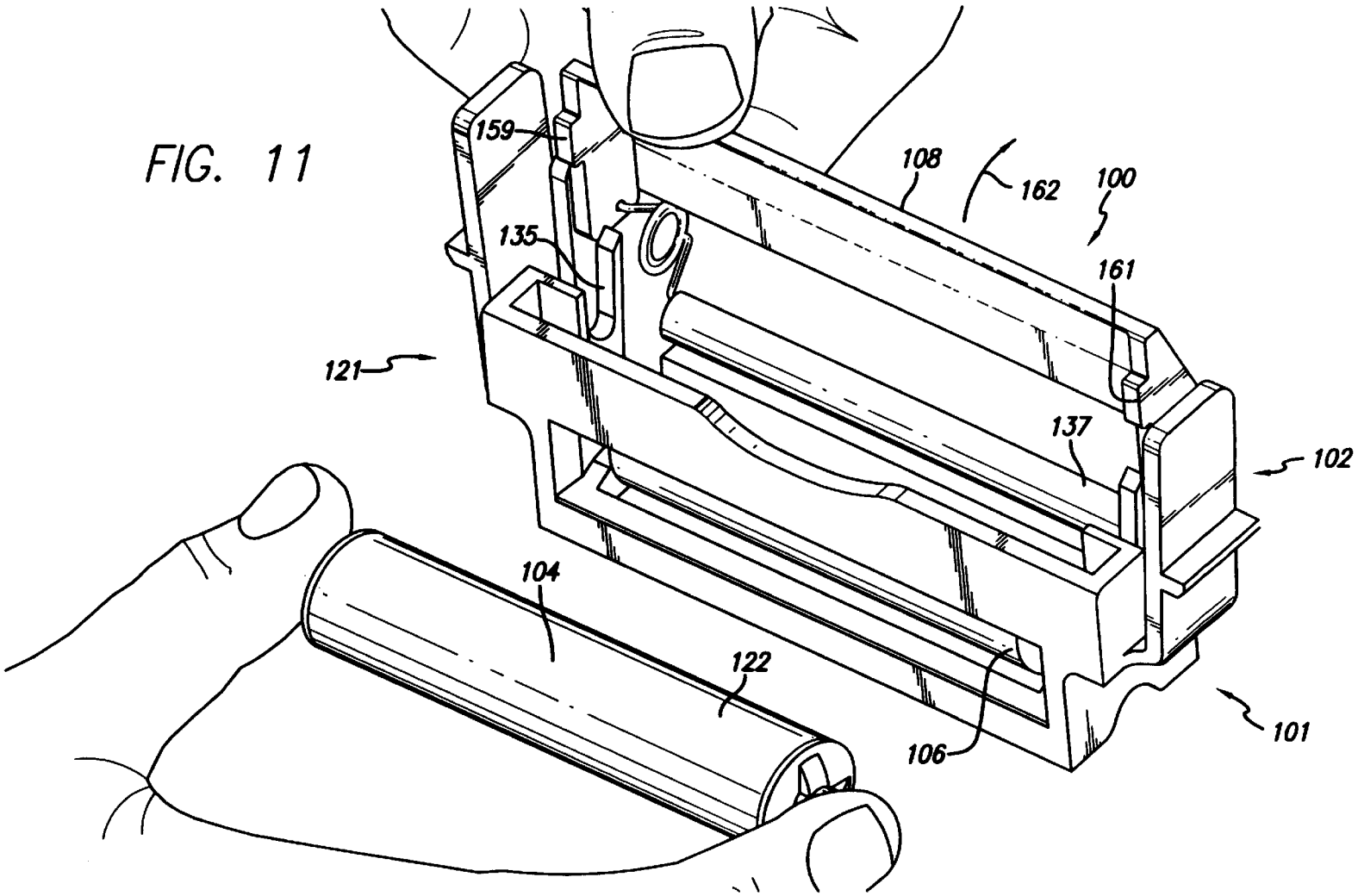
FIG. 11 is a further perspective and exploded view of the cleaning system assembly.
Figure 12:
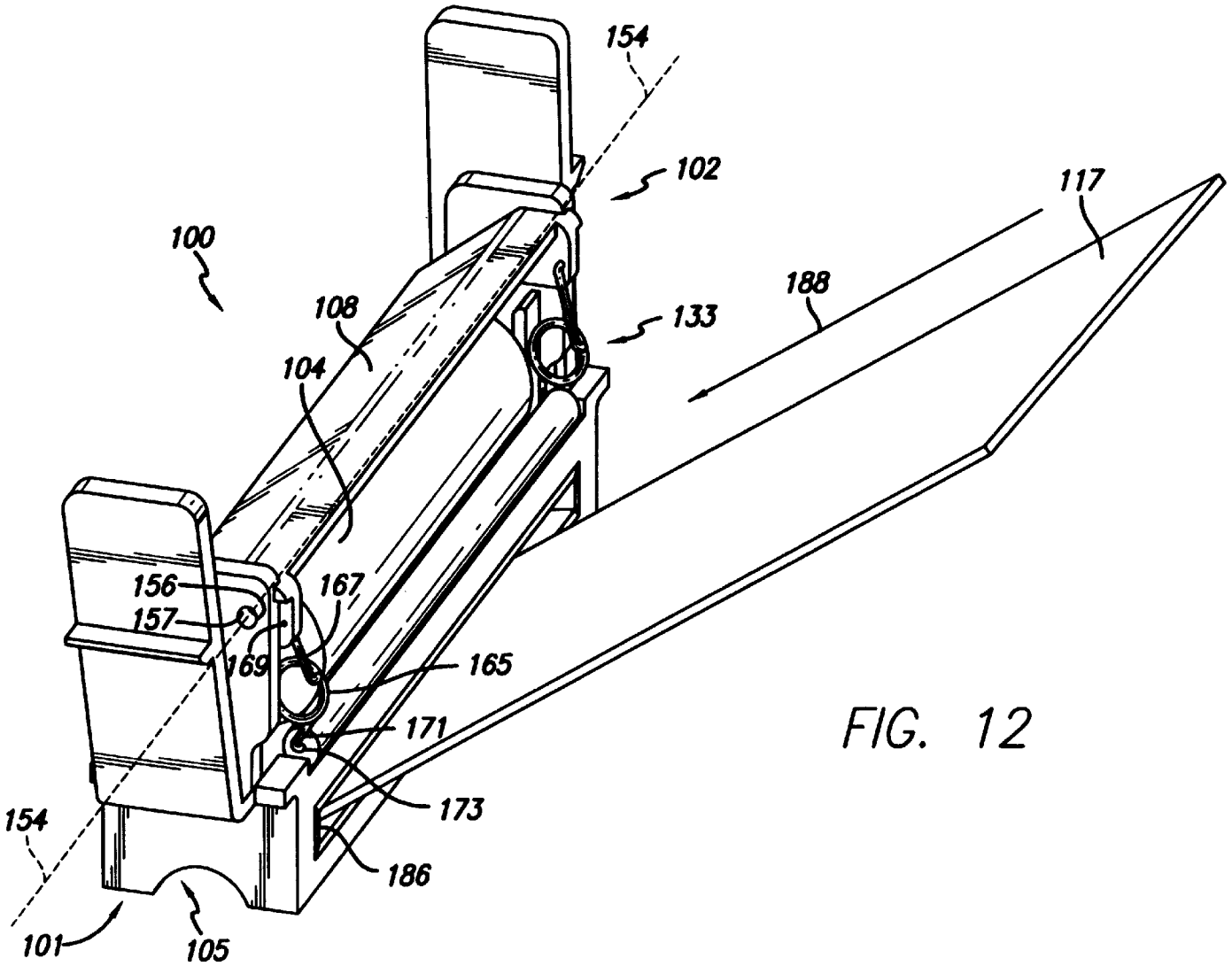
FIG. 12 is a perspective view of the cleaning system assembly showing a card partially inserted.
Figure 13:
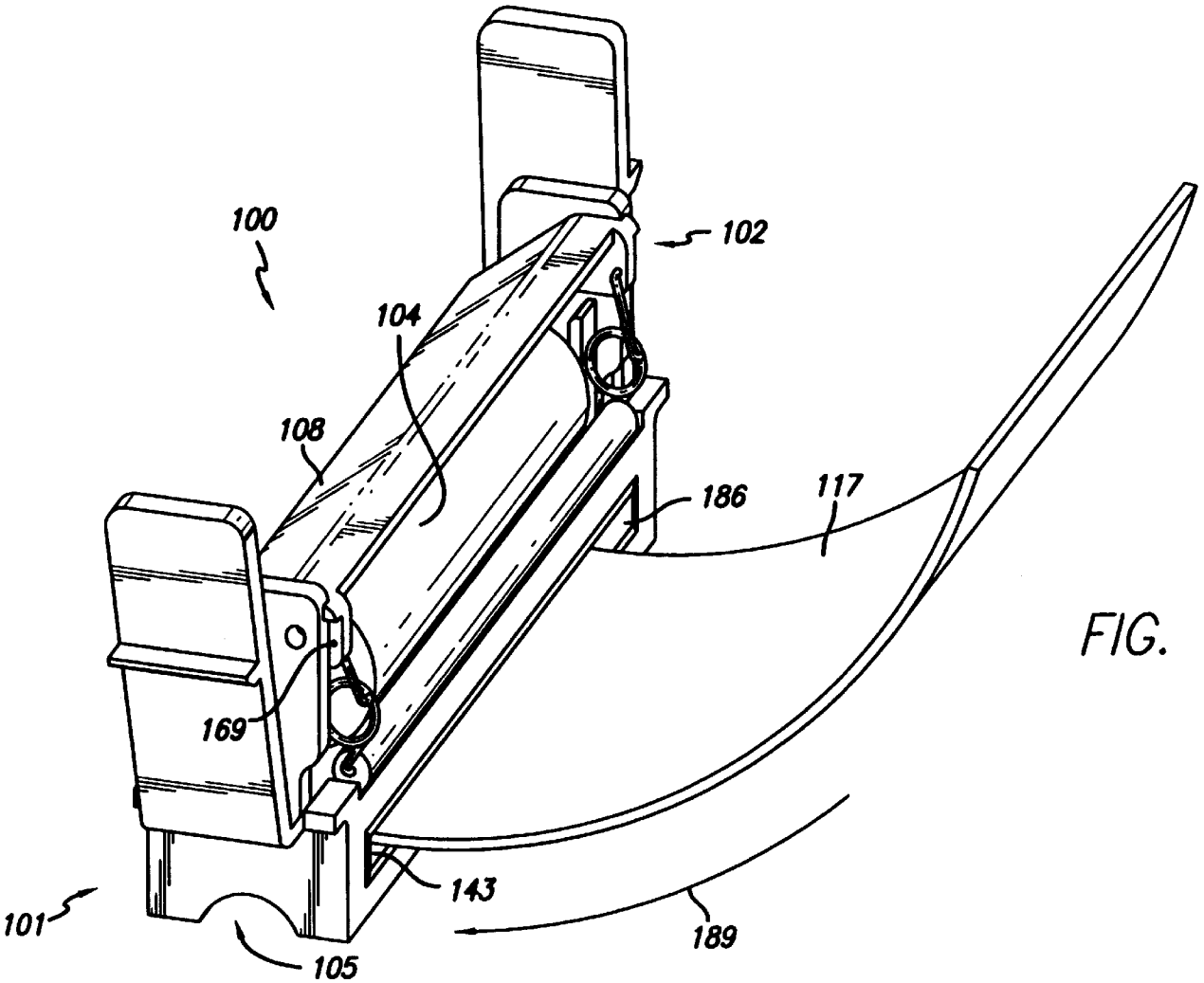
FIG. 13 is a perspective view of the cleaning system assembly showing the card further inserted.
Figure 14:
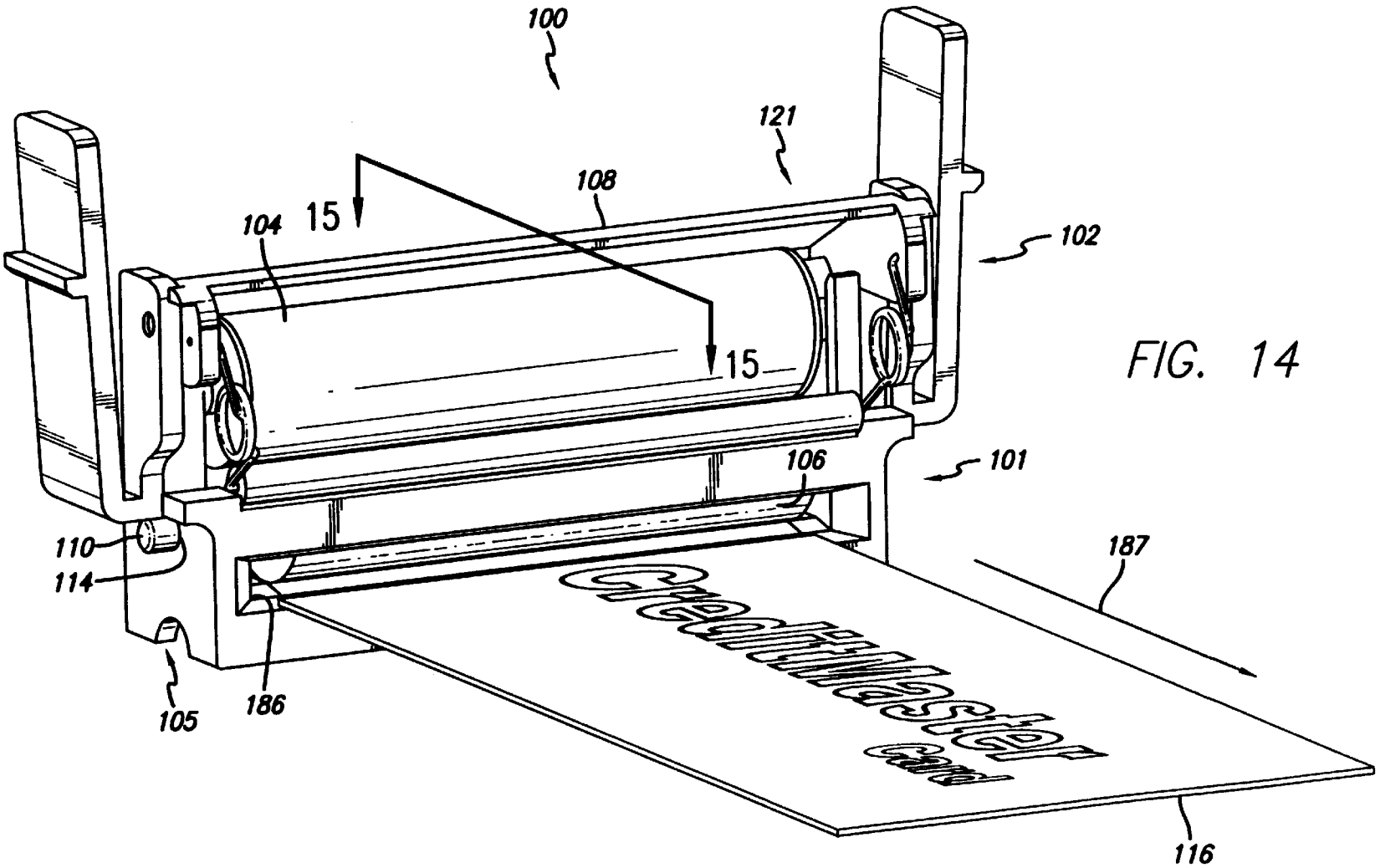
FIG. 14 is a perspective view of the cleaning system assembly showing the card leaving the assembly.
Figure 15:
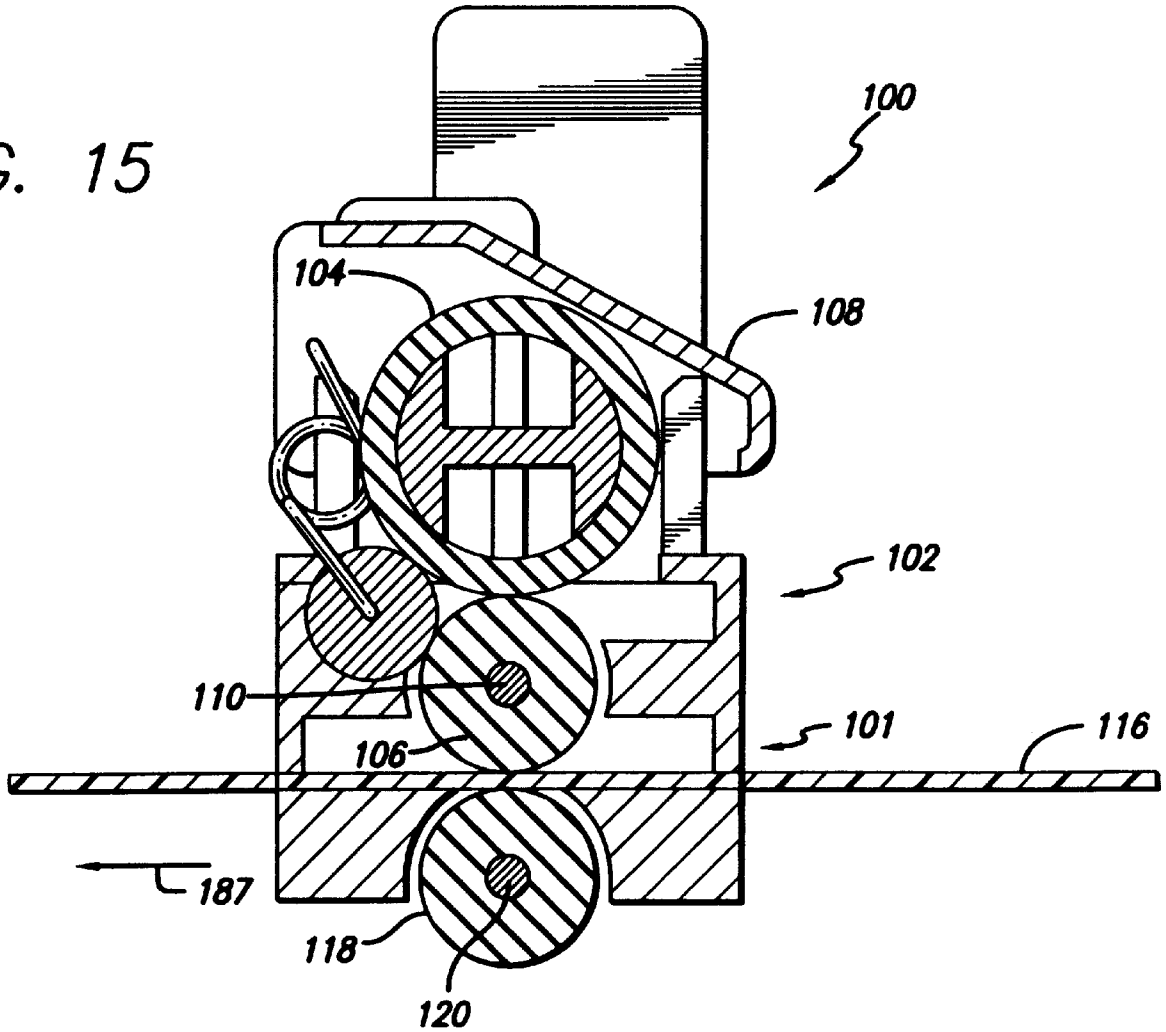
FIG. 15 is a cross-sectional elevational view of the cleaning system assembly with the card partially inserted.
Figure 16:
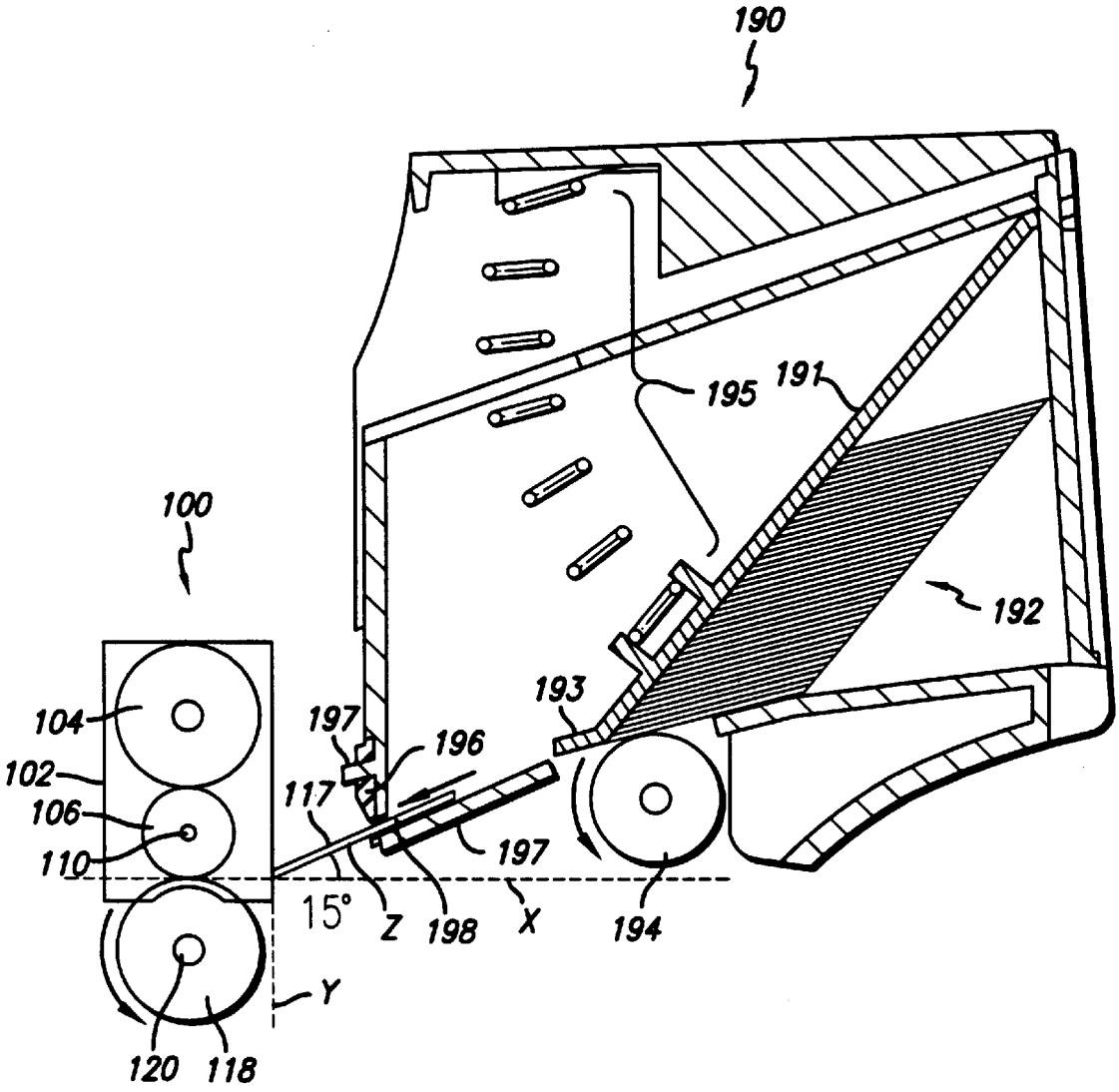
FIG. 16 is a cross-sectional elevational view of the cleaning system assembly and card feeder.
Figure 17:
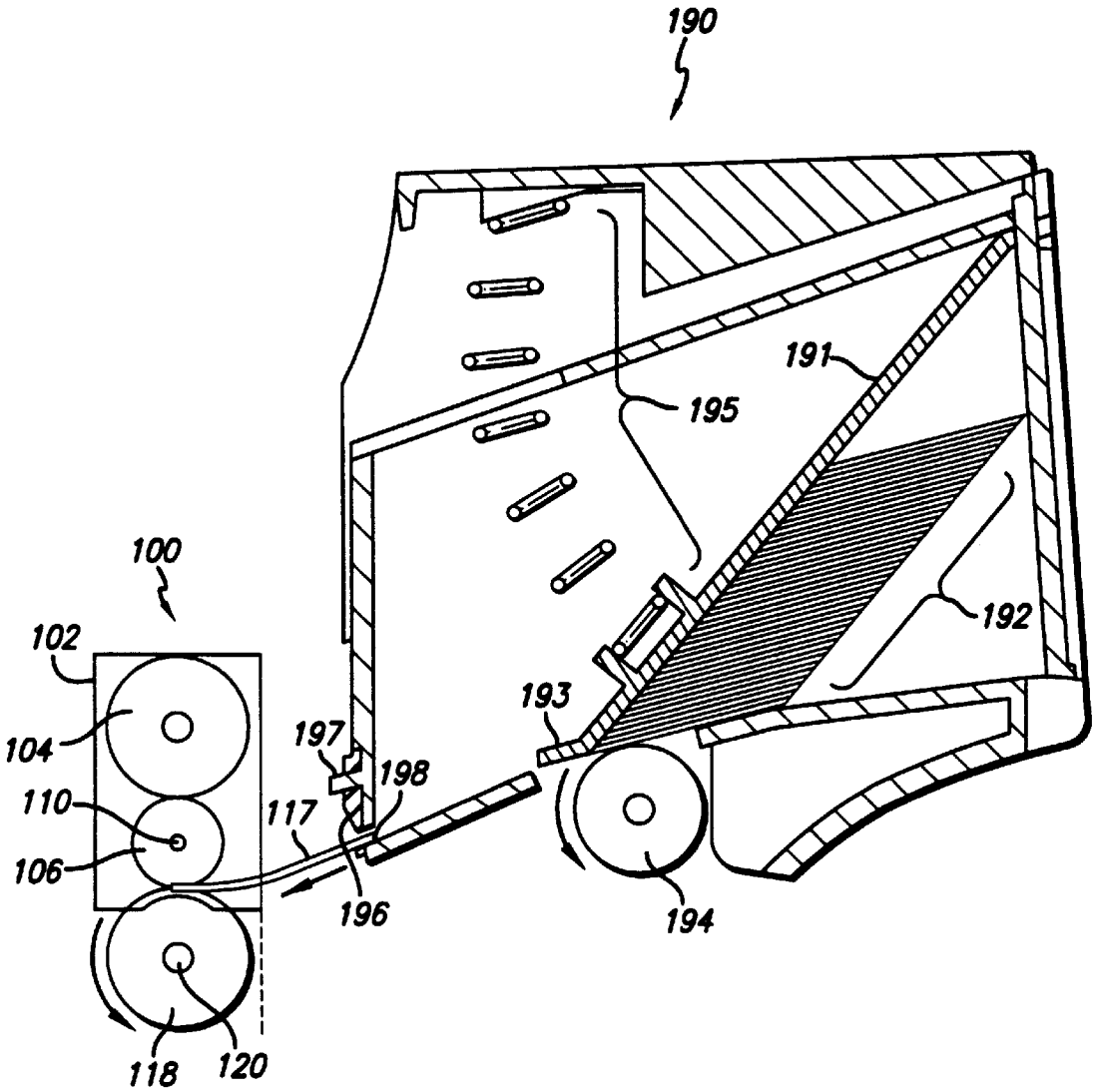
FIG. 17 is a cross-sectional elevational view of the cleaning system assembly and card feeder with a card partially inserted into the cleaning assembly.
Figure 18:
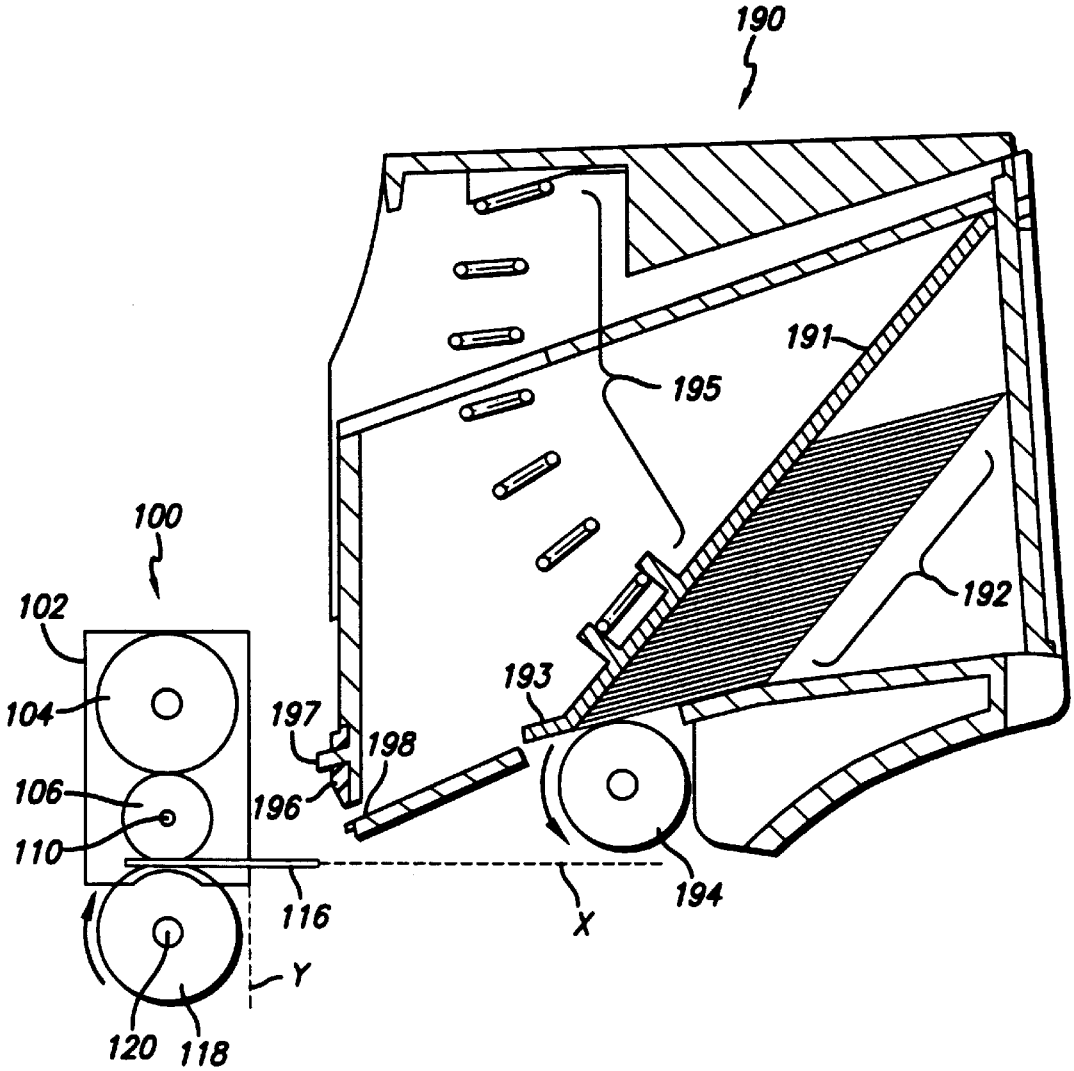
FIG. 18 is a cross-sectional elevational view of the cleaning system assembly and the card feeder with a card further inserted.
Figure 19:
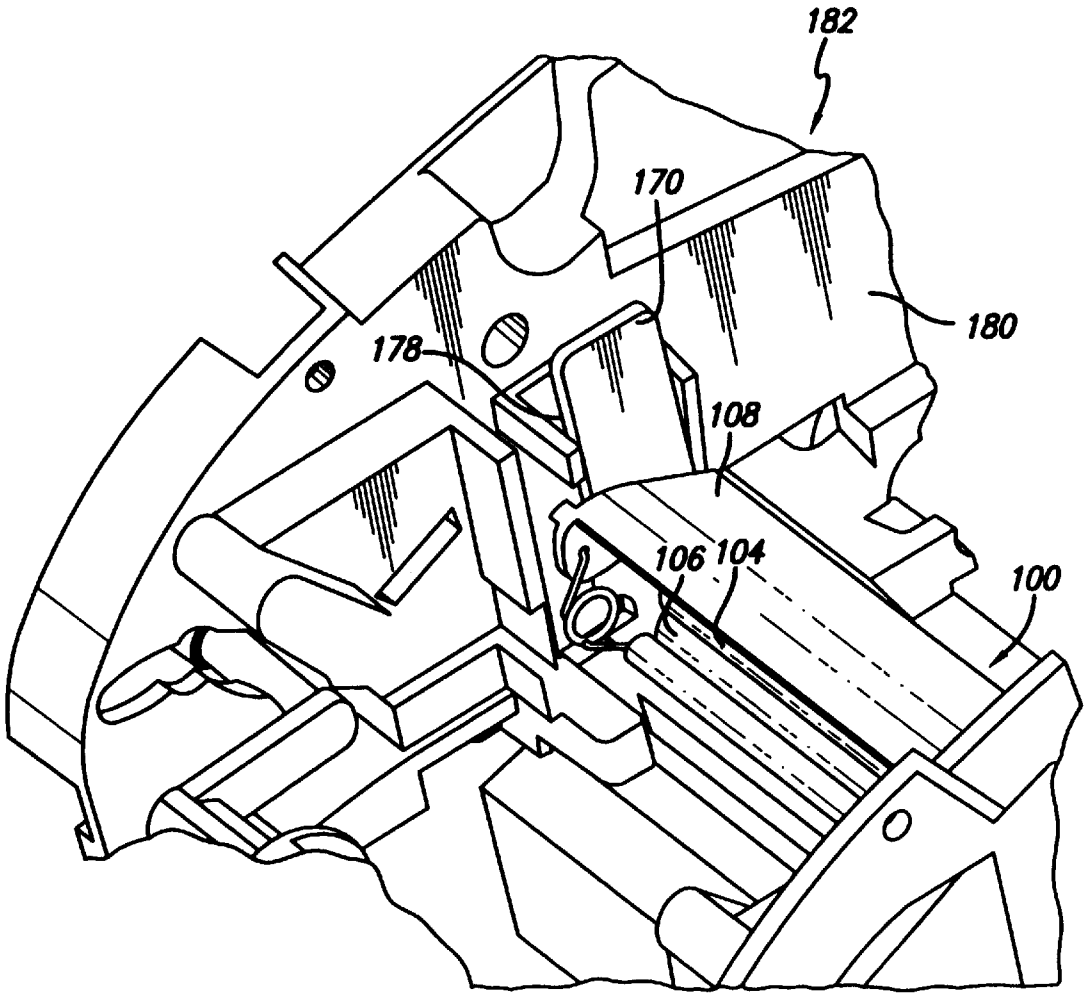
FIG. 19 is a top perspective view of the cleaning system assembly coupled into the printer.
Figure 20:
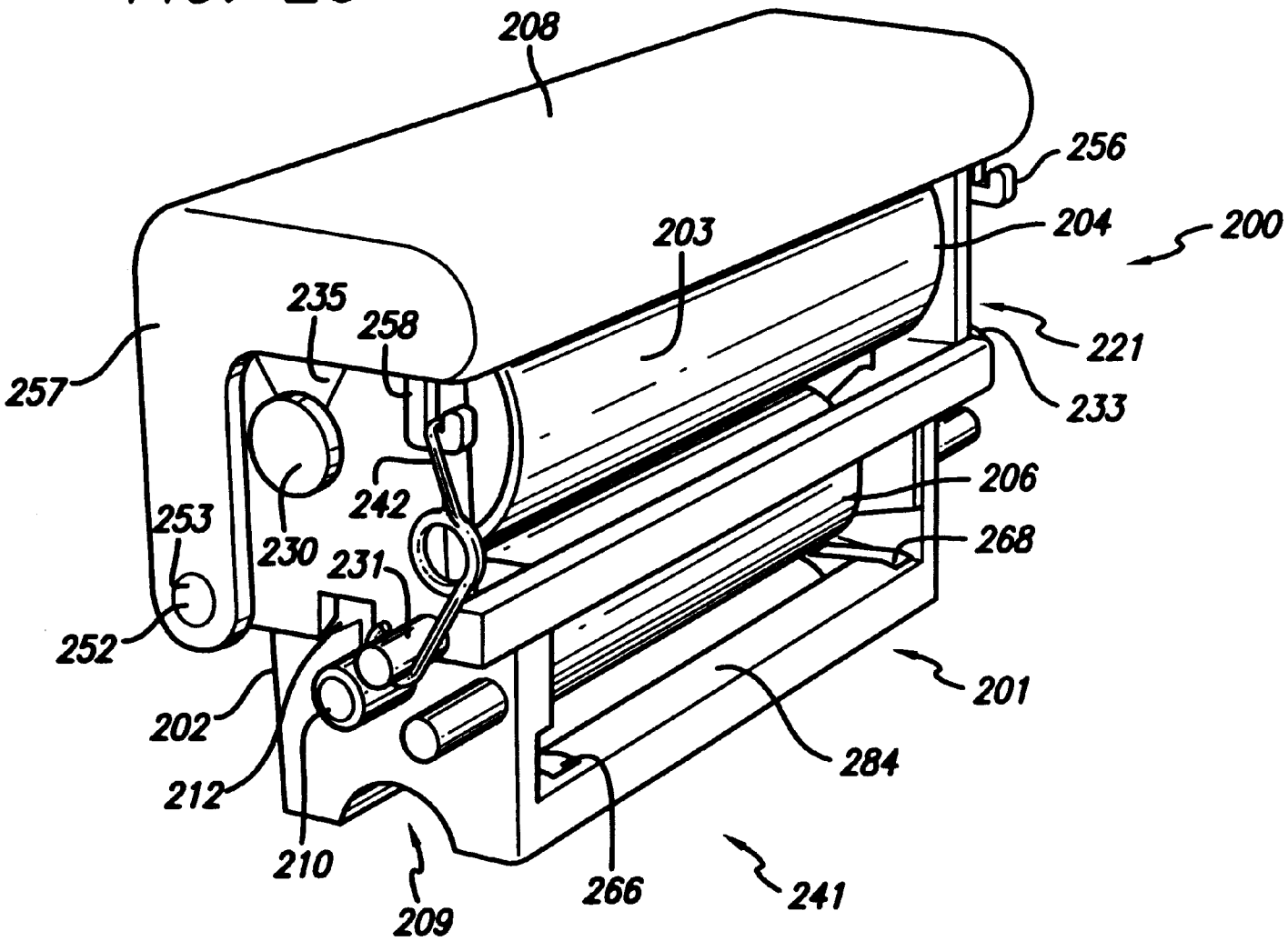
FIG. 20 is a perspective view of the cleaning system assembly.
Figure 21:
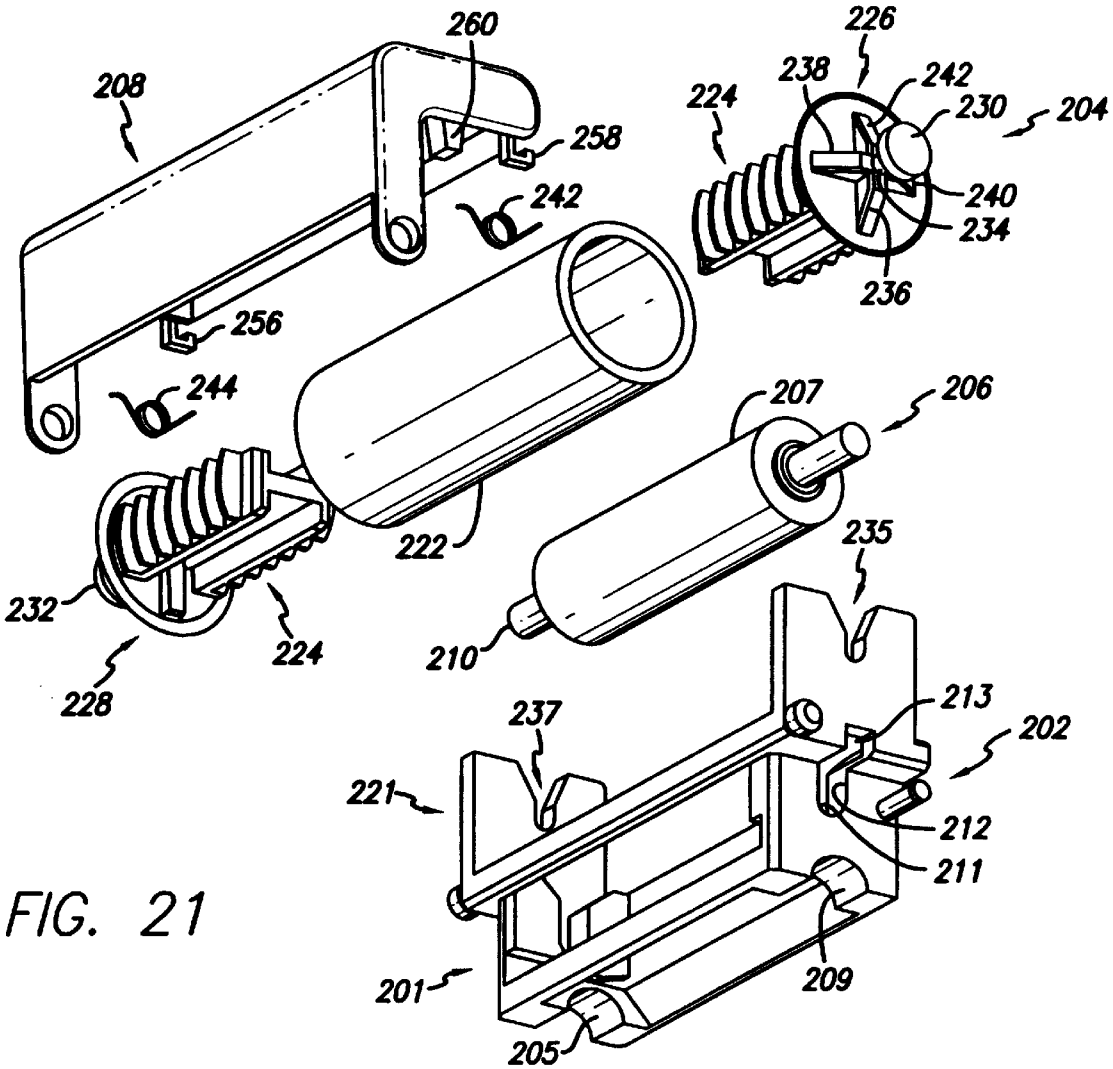
FIG. 21 is an exploded perspective view of a cleaning system assembly.
Figure 22:
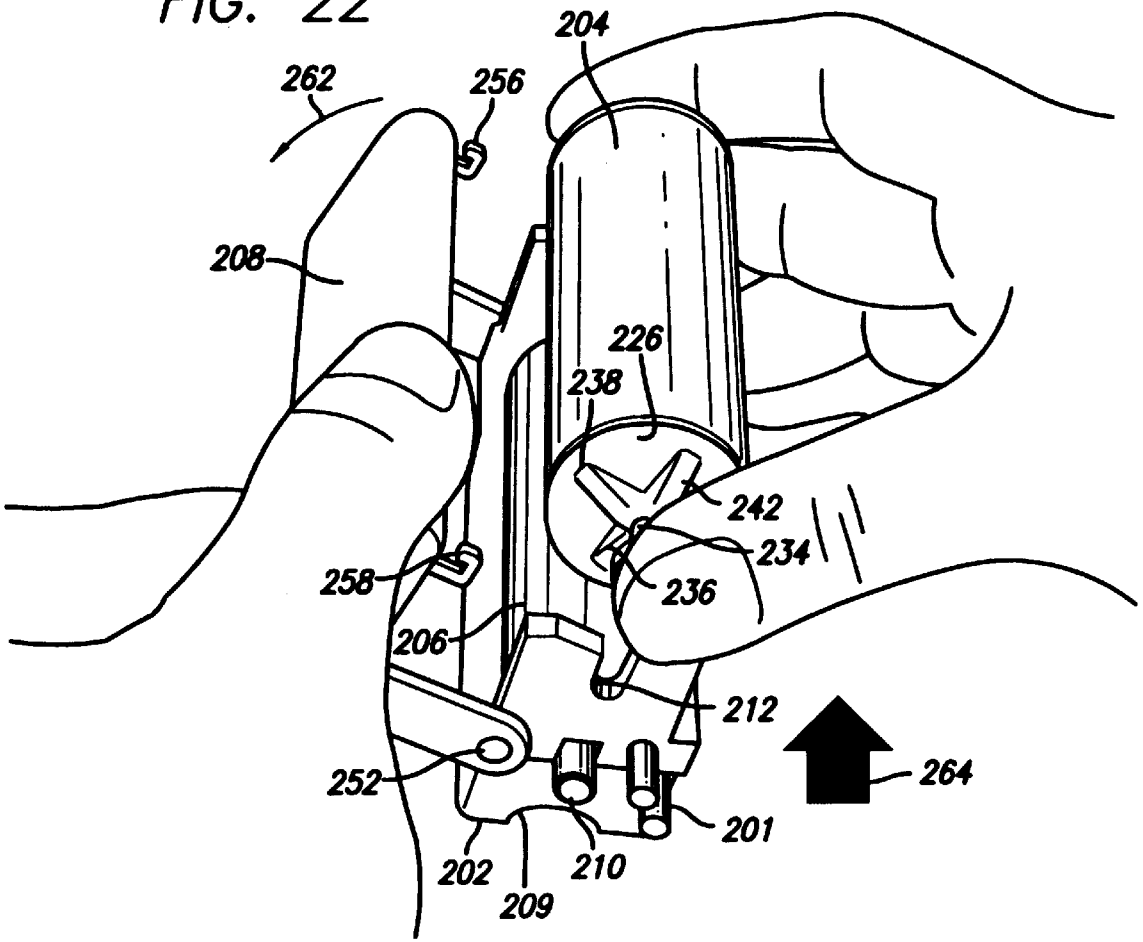
FIG. 22 is a perspective view of the cleaning system assembly showing the removal of one of the rollers.
Figures 23A, 23B:
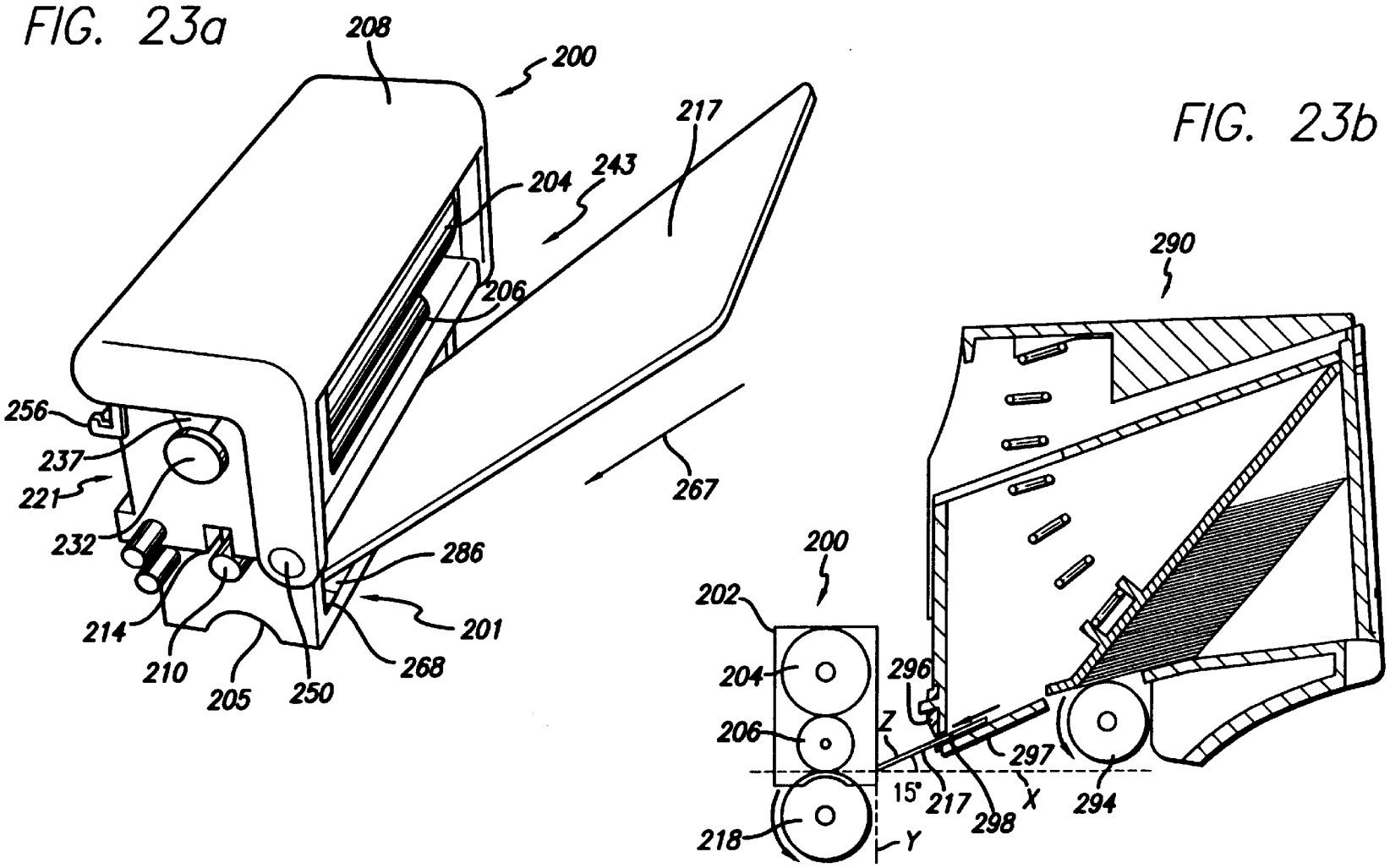
FIGS. 23A and 23B are perspective and cross-sectional elevational views, respectively, of a card being inserted into the cleaning system assembly and the relationship of the card feeder.
Figures 24A, 24B:
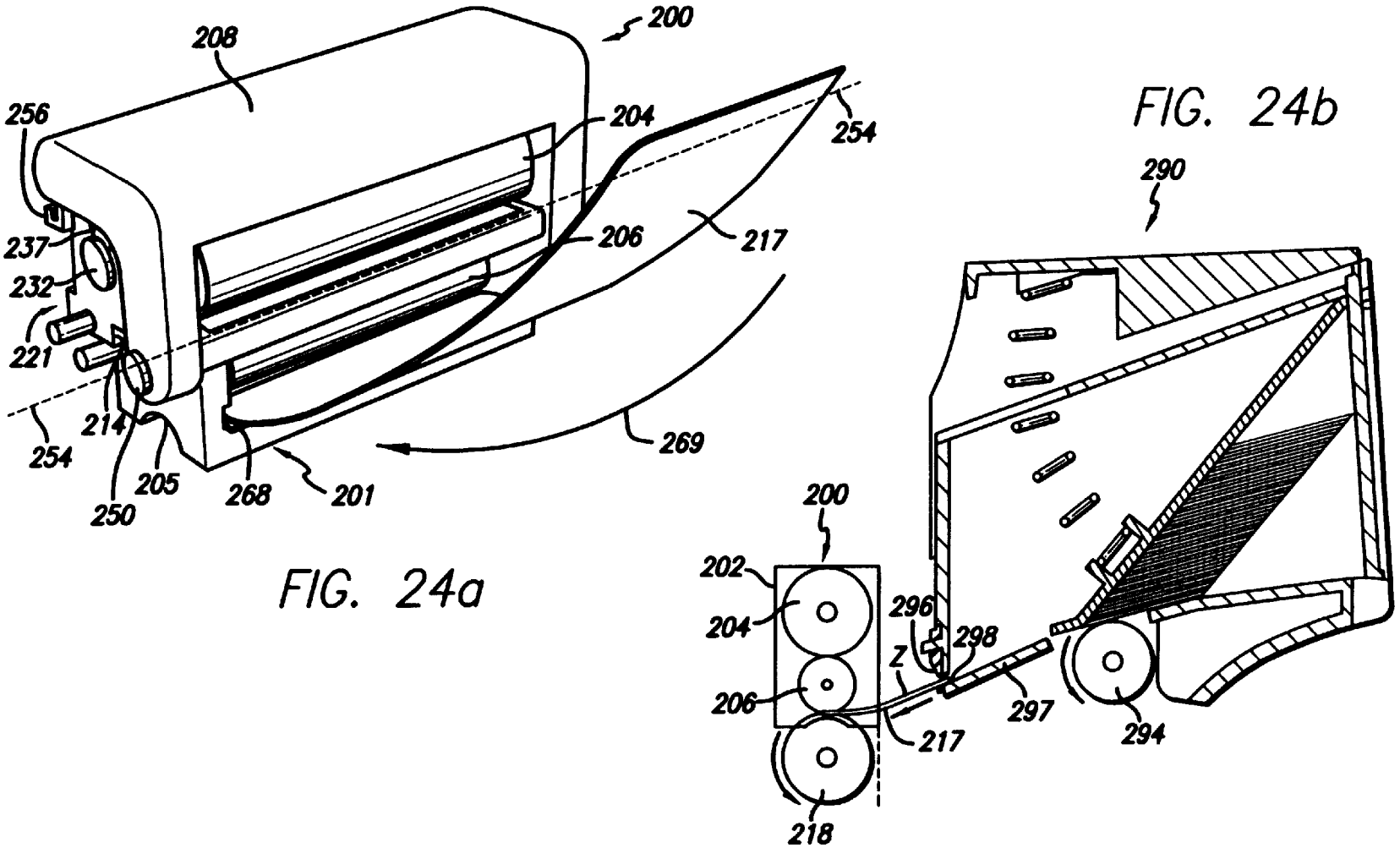
FIGS. 24A and 24B are a perspective view and a cross-sectional elevational view, respectively, of the cleaning system assembly with the card further inserted, and its relationship to the card feeder.
Figure 25B:
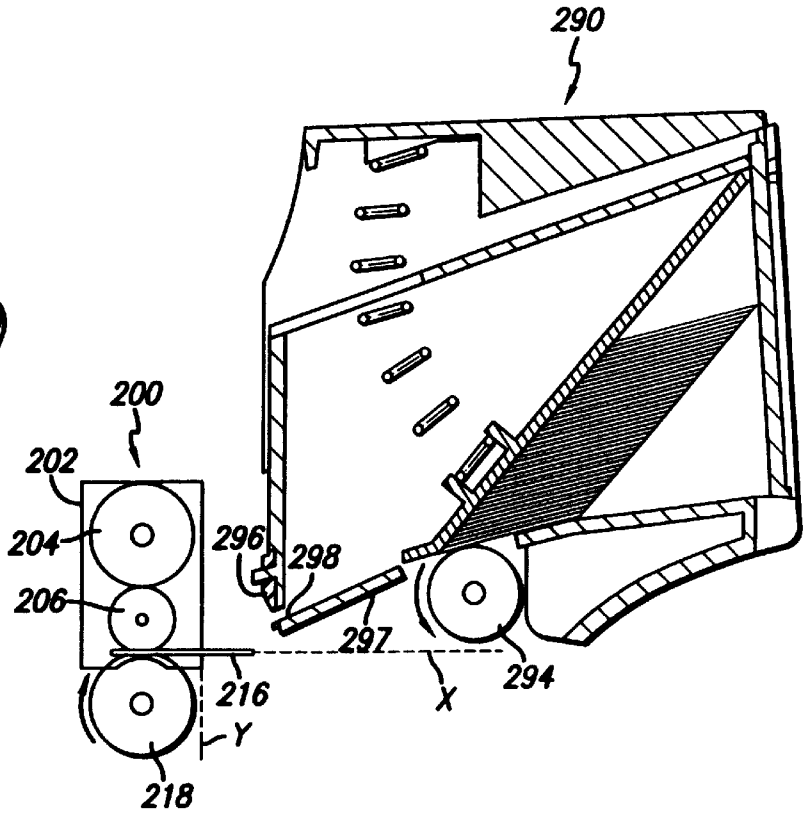
FIGS. 25A and 25B are a perspective view of the cleaning system assembly and a cross-sectional elevational view of the cleaning system assembly and card feeder, respectively, with the card further inserted into the cleaning system assembly.
Figure 25A:
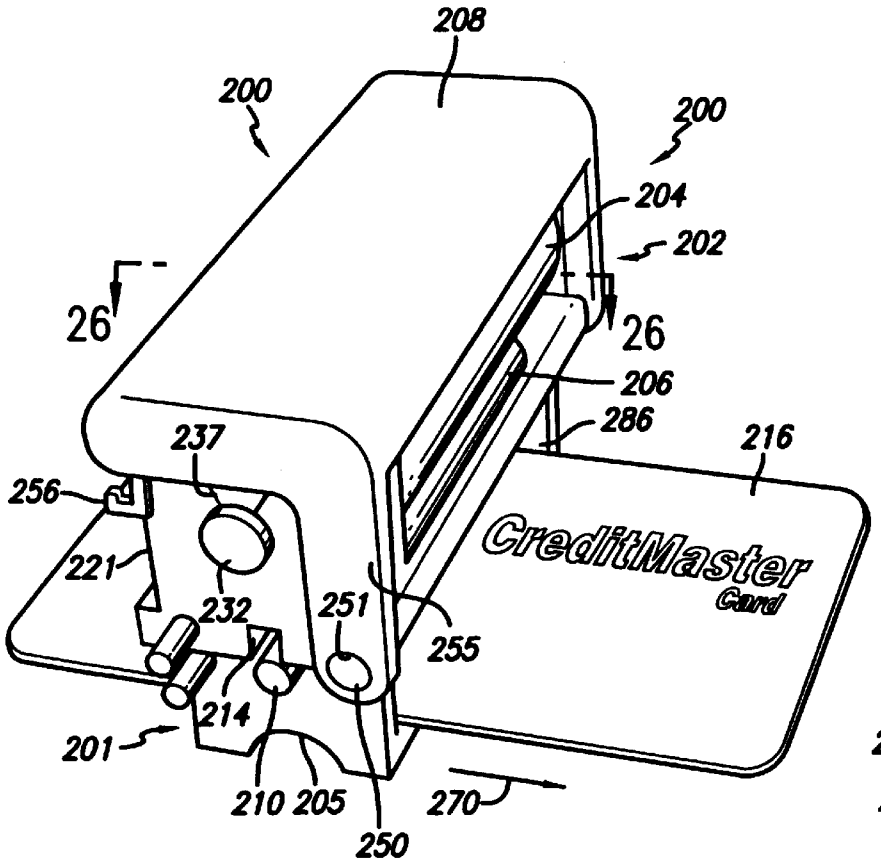
Figure 26:
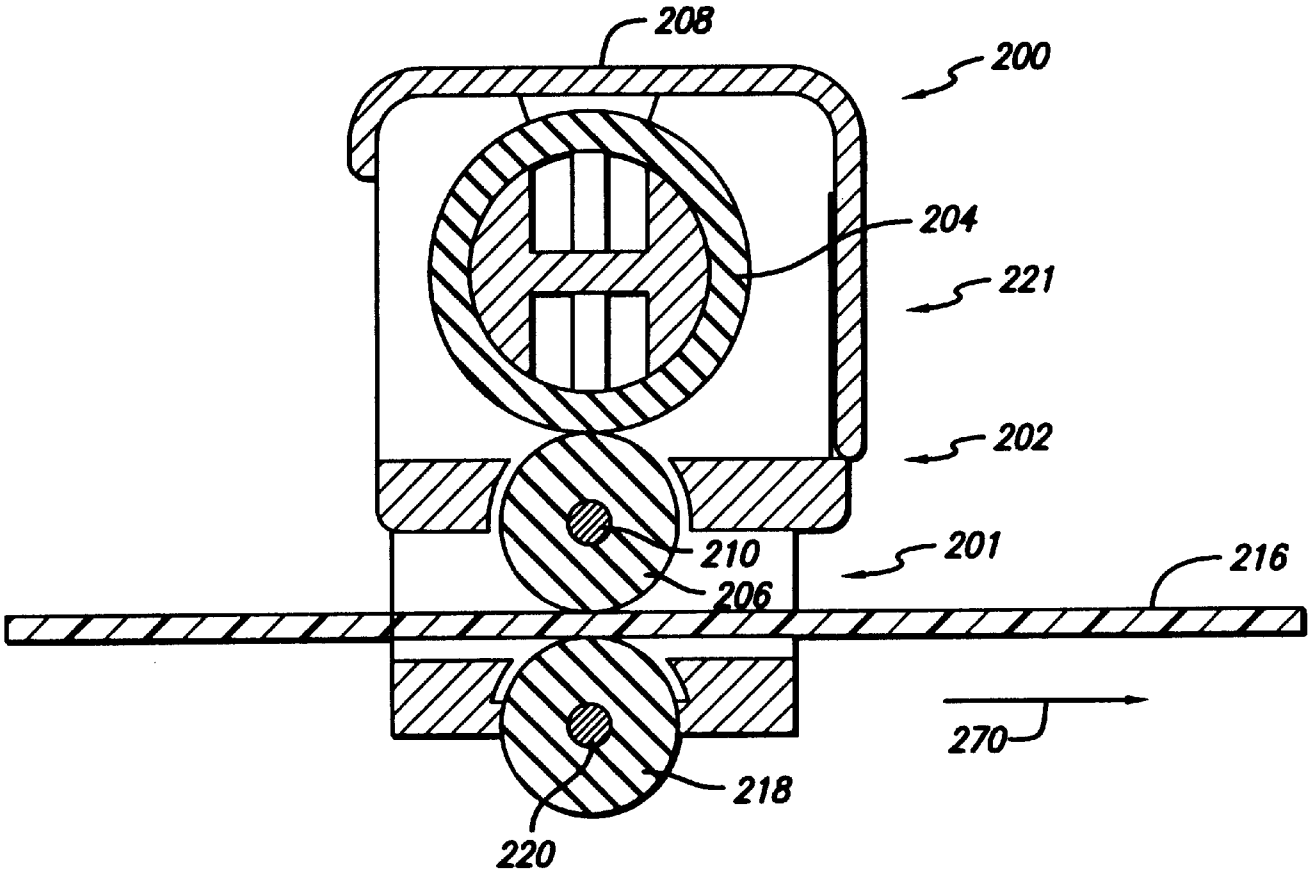
FIG. 26 is a cross-sectional elevational view showing the card exiting the cleaning system assembly.

Thus, the roller cartridge 10 is much easier to remove than removing the cleaning rollers in the conventional printers. To remove the roller cartridge 10, the user just pulls the handle 40 upward to disengage the magnets 68*a*, 68*b* from the metal plate 52, as shown in FIG. 6. Once the magnets 68*a*, 68*b* and the metal plate 52 are disengaged, the user may lift the roller cartridge 10 up until the roller cartridge 10 is displaced in an angle suitable for the latch 46 to slide out of the latch slot 50 (FIG. 5). To install the roller cartridge 10 onto the printer 1, a reverse process to the above-mentioned procedure is performed. Unlike the present invention, to remove a cleaning roller in a conventional printer the user needs to disengage the cleaning roller from two slots buried deep inside the conventional printer. Thus, the present invention improves the accessibility and the ease of replacement of the cleaning system greatly.

As mentioned, the upper cleaning roller 14 is made of cheap consumable materials and can be manually removed from the roller cartridge 10. The upper cleaning roller 14 has an end cap 28*a* or 28*b* (molded plastic) attached at each end, which allows the user to handle it without putting fingers on the sticky surface of the upper roller body 18. Any new upper cleaning roller 14 is delivered with a removable coating protecting the sticky surface from dust during transportation and from contacting with a shipping package. An optional configuration is to have a multi-sticking-coating upper cleaning roller 14. Thus, a dirty coating, which will usually be the outermost one, could be peeled off, making a new sticking coating to appear from underneath.

From the foregoing, it will be appreciated that, although specific embodiments of the invention have been described herein for purposes of illustration, various modifications may be made by persons skilled in the art without deviating from the spirit and/or scope of the invention. In particular, dimensions of all components can be varied for adapting to different-size image forming devices. The drive roller may also be made of silicone materials, making the drive roller suitable to clean the bottom surfaces of the cards. The leaf springs of the preferred embodiment may be replaced by alternative types of mechanisms to provide pressures to the upper and lower cleaning rollers.

What is claimed is:

1. A cleaning system adapted to be coupled to an image forming machine, comprising:

a removable cartridge, said removable cartridge having a cartridge frame and a cleaning means mounted on the cartridge frame for cleaning printable media fed into the image forming machine; and a conveyance means, said conveyance means being coupled to the image forming machine and being positioned under said removable cartridge for moving the printable media between said removable cartridge and said conveyance means.

2. The cleaning system of claim 1, wherein the cleaning means of said removable cartridge comprises:

a lower cleaning roller rotatably and movably coupled to said cartridge frame at opposite ends, said lower cleaning roller being adapted to press the printable media against said conveyance means for cleaning printing surfaces of the printable media; and an upper cleaning roller rotatably and removably coupled to said cartridge frame at opposite ends, said upper deaning roller being positioned substantially parallel and in contact with said lower cleaning roller for cleaning said lower cleaning roller.

3. The cleaning system of claim 2, wherein said removable cartridge further comprises an elastic mechanism adapted to press said upper cleaning roller downward against said lower cleaning roller.

4. The cleaning system of claim 3, wherein said elastic mechanism comprises first and second leaf springs respectively coupled to the cartridge frame at opposite ends.

5. The cleaning system of claim 3, wherein said lower cleaning roller comprises:

a lower roller shaft rotatably coupled to opposite ends of the cartridge frame, said lower roller shaft being vertically movable with respect to the cartridge frame; and a lower roller body securely encircling said lower roller shaft, said lower roller body rotatably pressing the printable media against said conveyance means.

6. The cleaning system of claim 5, wherein said lower roller body is made of silicone materials and has a sticky and low hardness surface, the sticky surface of said lower roller body being adapted to remove dust or polluting materials deposited on the printable media by rolling over the printable media.

7. The cleaning system of claim 3, wherein said upper cleaning roller comprises:

an upper roller body, said upper roller body being adapted to rotatably press against said lower cleaning roller for cleaning said lower cleaning roller; and a support means, said support means being securely coupled to said upper roller body and being rotatably coupled to the cartridge frame at opposite ends wherein said elastic mechanism presses said support means forcing said upper roller body to press against said lower cleaning roller.

8. The cleaning system of claim 7, wherein said support means comprises first and second end caps respectively mounted to said upper roller body at opposite ends, said first and second end caps being adapted to be removably and rotatably coupled to opposite ends of the cartridge frame.

9. The cleaning system of claim 8, wherein said first and second end caps respectively comprises:

a support rack adapted to be inserted into one end of said upper roller body; and a cap nob, said cap nob having a narrow neck integrated to said support rack wherein the narrow neck is adapted to be removably inserted into a sliding slot of the cartridge frame.

10. The cleaning system of claim 7, wherein said upper roller body comprises:

a roller support tube, said roller support tube being coupled to said support means for supporting to the cartridge frame; and a sticky strip encircling said roller support tube, said sticky strip having a sticky surface adapted to remove dust or polluting materials deposited on the surface of said lower cleaning roller by rolling against said lower cleaning roller.

11. The cleaning system of claim 10, wherein said sticky strip of said upper roller body comprises one or more layers, each layer of said sticky strip having a sticky surface and being removable by peeling it off from the sticky strip.

12. The cleaning system of claim 1, further comprising a magnetic mechanism for securing the cartridge frame to the image forming machine.

13. The cleaning system of claim 12, wherein said magnetic mechanism comprises at least one magnet disposed substantially at one end of the cartridge frame for fastening to a corresponding metal plate on the image forming machine.

14. The cleaning system of claim 13, further comprising means for unfastening said at least one magnet from said metal plate on said image forming machine.

15. The cleaning system of claim 14, wherein unfastening means includes a handle disposed away from said magnetic mechanism at another end of said cartridge frame for pulling said removable cartridge away from said metal plate on said image forming machine.

16. The cleaning system of claim 12, wherein said magnetic mechanism comprises two magnets disposed substantially in parallel at one end of the cartridge frame for fastening to a corresponding metal plate on the image forming machine.

17. The cleaning system of claim 16, further comprising means for unfastening said two magnets from said metal plate on said image forming machine.

18. The cleaning system of claim 17, wherein said unfastening means includes a handle disposed away from said magnetic mechanism at another end of said cartridge frame for pulling said removable cartridge away from said metal plate on said image forming machine.

19. The cleaning system of claim 1, wherein said conveyance means comprises a drive roller securely coupled to the image forming machine, said drive roller being adapted to rotatably press the printable media against the cleaning means of said removable cartridge for moving the printable media.

20. The cleaning system of claim 1, further comprising means for fastening said removable cartridge to said image forming machine.

21. The cleaning system of claim 20, wherein said fastening means includes a latch disposed substantially at one end of said cartridge frame for removable coupling to a corresponding latch slot on said image forming machine.

22. A cleaning device adapted to be coupled to an image forming machine, the cleaning device comprising:

a removable cartridge having a cartridge frame adapted to be coupled to the device; and cleaning means comprising a lower cleaning roller coupled to the cartridge frame and an upper cleaning roller removably coupled to the cartridge frame, the lower cleaning roller being adapted to remove debris from printable media fed into the image forming machine and the upper cleaning roller being adapted to remove debris from the lower cleaning roller.

23. The cleaning device of claim 22, wherein the cleaning means of said removable cartridge comprises:

the lower cleaning roller, said lower cleaning roller having a lower roller body encircling a lower roller shaft rotatably and movably coupled to the cartridge frame, the lower roller body being adapted to clean dust or polluting materials deposited on the printable media;

the upper cleaning roller rotatably and removably coupled to said cartridge frame at opposite ends, said upper cleaning roller being positioned substantially parallel and in contact with said lower cleaning roller for cleaning said lower cleaning roller; and an elastic mechanism coupled to the cartridge frame and adapted to press said upper cleaning roller downward against said lower cleaning roller.

24. The cleaning device of claim 23, wherein said elastic mechanism comprises first and second leaf springs coupled to the cartridge frame at opposite ends and adapted to press said upper cleaning roller downward against said lower cleaning roller.

25. The cleaning device of claim 23, wherein said lower roller body is made of silicone materials and has a sticky and low hardness surface, the sticky surface of said lower roller body being adapted to remove dust or polluting materials deposited on the printable media by rolling over the printable media.

26. The cleaning device of claim 23, wherein said upper cleaning roller comprises:

an upper roller body, said upper roller body being adapted to rotatably press against said lower cleaning roller for cleaning said lower cleaning roller; and a roller support means, said roller support means being securely coupled to said upper roller body and being rotatably and removably coupled to the cartridge frame at opposite ends, said roller support means being pressed by said elastic mechanism downward forcing said upper roller body to press against said lower cleaning roller.

27. The cleaning device of claim 26, wherein said roller support means comprises first and second end caps respectively mounted to said upper roller body at opposite ends, said first and second end caps being adapted to be removably and rotatably coupled to opposite ends of the cartridge frame.

28. The cleaning device of claim 26, wherein said upper roller body comprises:

a roller support tube, said roller support tube being coupled to a first and a second end cap for supporting said roller support tube to the cartridge frame; and a sticky strip encircling said roller support tube, said sticky strip having a sticky surface adapted to remove dust or polluting materials deposited on the surface of said lower cleaning roller by rolling against said lower cleaning roller.

29. The cleaning device of claim 22, further comprising a magnetic mechanism for securing the cleaning device to the image forming machine.

30. The cleaning device of claim 29, wherein said magnetic mechanism comprises at least one magnet disposed substantially at one end of the cartridge frame for fastening to a corresponding metal plate on the image forming machine.

31. The cleaning device of claim 30, further comprising means for unfastening said at least one magnet from said metal plate on said image forming machine.

32. The cleaning device of claim 31, wherein unfastening means includes a handle disposed away from said magnetic mechanism at another end of said cartridge frame for pulling said removable cartridge away from said metal plate on said image forming machine.

33. The cleaning device of claim 29, wherein said magnetic mechanism comprises two magnets disposed substantially in parallel at one end of the cartridge frame for fastening to a corresponding metal plate on the image forming machine.

34. The cleaning device of claim 33, further comprising means for unfastening said two magnets from said metal plate on said image forming machine.

35. The cleaning device of claim 34, wherein unfastening means includes a handle disposed away from said magnetic mechanism at another end of said cartridge frame for pulling said removable cartridge away from said metal plate on said image forming machine.

36. The cleaning device of claim 22, further comprising means for fastening said removable cartridge to said image forming machine.

37. The cleaning device of claim 36, wherein said fastening means includes a latch disposed substantially at one end of said cartridge frame for removable coupling to a corresponding latch slot on said image forming machine.

* * * * *